US007896673B2

(12) United States Patent
Kim

(10) Patent No.: US 7,896,673 B2
(45) Date of Patent: Mar. 1, 2011

(54) LAMP SOCKET, BACKLIGHT ASSEMBLY INCLUDING THE LAMP SOCKET, AND LIQUID CRYSTAL DISPLAY INCLUDING THE BACKLIGHT ASSEMBLY

(75) Inventor: Yong-il Kim, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 12/633,969

(22) Filed: Dec. 9, 2009

(65) Prior Publication Data

US 2010/0157194 A1 Jun. 24, 2010

Related U.S. Application Data

(62) Division of application No. 11/765,156, filed on Jun. 19, 2007, now Pat. No. 7,651,354.

(30) Foreign Application Priority Data

Jun. 27, 2006 (KR) ..... 10-2006-0057874

(51) Int. Cl.
*H01R 33/02* (2006.01)

(52) U.S. Cl. ..... 439/226; 439/558; 439/620.02; 362/631

(58) Field of Classification Search ..... 439/226–244, 439/620.02, 558; 362/631–633
See application file for complete search history.

(56) References Cited

U.S. PATENT DOCUMENTS 2,957,157 A 10/1960 Carter
3,138,418 A 6/1964 Dazley et al.
3,176,260 A 3/1965 Pascucci
4,130,860 A 12/1978 Careglio et al.
4,708,715 A 11/1987 Troutner et al.
5,013,253 A 5/1991 Aiello et al.
2002/0086573 A1 * 7/2002 You ..... 439/226

FOREIGN PATENT DOCUMENTS

CN 1776504 A 5/2006
GB 577145 5/1946
GB 2324420 10/1998

OTHER PUBLICATIONS

Chinese Office Action dated Mar. 9, 2010 issued during the examination of the corresponding Chinese patent application. (No. 200710109511.7).
Extended European Search Report for Application No. 07012142.1-1268 dated Oct. 15, 2007.

* cited by examiner

*Primary Examiner*—Gary F. Paumen
(74) *Attorney, Agent, or Firm*—Cantor Colburn LLP

(57) ABSTRACT

A lamp socket includes a lamp connection unit which is electrically connected to a lamp, a power connection unit which is disposed below and adjacent to the lamp connection unit along a longitudinal axis and is electrically connected to an electric source which supplies power to the lamp, and a fastening member which is disposed on the power connection unit, wherein the power connection unit comprises at least one sub-component which has a surface area perpendicular to the longitudinal axis which is larger than the largest surface area of the lamp connection unit perpendicular to the longitudinal axis and wherein the sub-component of the power connection unit with the largest surface area perpendicular to the longitudinal axis is located proximate to the lamp connection unit.

12 Claims, 21 Drawing Sheets

LAMP SOCKET, BACKLIGHT ASSEMBLY INCLUDING THE LAMP SOCKET, AND LIQUID CRYSTAL DISPLAY INCLUDING THE BACKLIGHT ASSEMBLY

CROSS REFERENCE TO RELATED APPLICATION

This application is a divisional application of U.S. patent application Ser. No. 11/765,156, filed on Jun. 19, 2007, which claims priority to Korean Patent Application No. 10-2006-0057874, filed on Jun. 27, 2006, and all the benefits accruing therefrom under 35 U.S.C. §119, the contents of which in its entirety are herein incorporated by reference.

BACKGROUND OF THE INVENTION

1. Field of the Invention

The present invention relates to a lamp socket, a backlight assembly including the lamp socket, and a liquid crystal display including the backlight assembly. More particularly, the present invention relates to a lamp socket capable of easy assembly and a reduction in manufacturing costs, a backlight assembly including the lamp socket, and a liquid crystal display including the backlight assembly.

2. Description of the Related Art

Liquid crystal displays are one of the most commonly used flat panel displays. Liquid crystal displays, which include two panels having a plurality of electrodes thereon and a liquid crystal layer interposed between the two panels, control the transmittance of incident light by applying voltages to the electrodes to rearrange liquid crystal molecules of the liquid crystal layer. The liquid crystal molecules may be oriented to allow light to pass therethrough, may be oriented to block light from passing therethrough, or may be oriented to allow only a portion of the light to pass therethrough.

Liquid crystal displays include a backlight assembly for supplying light to the liquid crystal layer. The backlight assembly typically includes lamps, various types of optical sheets, and a housing unit for receiving the lamps and the optical sheets. Conventionally, sockets are used to fasten the lamps into the housing unit. With respect to conventional liquid crystal displays using a plurality of lamps arranged in an ordered fashion, an alignment plate is used for securing the sockets coupled with the lamps to the housing unit. The sockets are secured to the housing unit with an alignment plate after being inserted into holes formed in the housing unit.

According to the above-described conventional liquid crystal displays, an alignment plate is separately used to secure sockets to a housing unit, thereby complicating the liquid crystal display assembly process. Furthermore, the arrangement of sockets may need to be changed according to the type of liquid crystal display used, which requires the fabrication of a new alignment plate configured for the arrangement of sockets, thereby resulting in an increase in both manufacturing costs and manufacturing time.

BRIEF SUMMARY OF THE INVENTION

The present invention provides a lamp socket capable of achieving easy assembling and a reduction in manufacturing costs.

The present invention also provides a backlight assembly including the lamp socket.

The present invention also provides a liquid crystal display including the backlight assembly These and other aspects of the present invention will be described in or be apparent from the following description of the exemplary embodiments.

According to an exemplary embodiment of the present invention, a lamp socket includes a lamp connection unit which is electrically connected to a lamp, a power connection unit which is disposed below and adjacent to the lamp connection unit along a longitudinal axis and is electrically connected to an electric source which supplies power to the lamp, and a fastening member which is disposed on the power connection unit, wherein the power connection unit comprises at least one sub-component which has a surface area perpendicular to the longitudinal axis which is larger than the largest surface area of the lamp connection unit perpendicular to the longitudinal axis and wherein the sub-component of the power connection unit with the largest surface area perpendicular to the longitudinal axis is located proximate to the lamp connection unit.

According to another exemplary embodiment of the present invention, a lamp socket includes a power connection unit which is electrically connected to an electric source which supplies power to a lamp, a lamp connection unit which is disposed above and adjacent to the power connection unit along a longitudinal axis and is electrically connected to the lamp, and a fastening member which is disposed on the lamp connection unit, wherein the lamp connection unit comprises at least one sub-component which has a surface area perpendicular to the longitudinal axis which is larger than the largest surface area of the power connection unit perpendicular to the longitudinal axis and wherein the sub-component of the lamp connection unit with the largest surface area perpendicular to the longitudinal axis is located proximate to the power connection unit.

According to still another exemplary embodiment of the present invention, a backlight assembly includes at least one lamp, a housing unit which receives the at least one lamp and has socket holes corresponding to ends of the at least one lamp, and lamp sockets which are inserted into the socket holes and are connected to the lamps, wherein each of the lamp sockets comprises a lamp connection unit which is electrically connected to a lamp, a power connection unit which is disposed below and adjacent to the lamp connection unit along a longitudinal axis and is electrically connected to an electric source which supplies power to the lamp, and a fastening member which is disposed on the power connection unit and is secured to the socket hole, wherein the power connection unit comprises at least one sub-component which has a surface area perpendicular to the longitudinal axis which is larger than the largest surface area of the lamp connection unit perpendicular to the longitudinal axis and wherein the sub-component of the power connection unit with the largest surface area perpendicular to the longitudinal axis is located proximate to the lamp connection unit.

According to a further exemplary embodiment of the present invention, a backlight assembly includes at least one lamp, a housing unit which receives the at least one lamp and has socket holes corresponding to ends of the at least one lamp, and lamp sockets which are inserted into the socket holes and are connected to the at least one lamp, wherein each of the lamp sockets comprises a power connection unit which is electrically connected to an electric source which supplies power to a lamp, a lamp connection unit which is disposed above and adjacent to the power connection unit along a longitudinal axis and is electrically connected to the lamp, and a fastening member which is disposed on the lamp connection unit and is secured to the socket hole, wherein the lamp connection unit comprises at least one sub-component which has a surface area perpendicular to the longitudinal axis which is larger than the largest surface area of the power connection unit perpendicular to the longitudinal axis and wherein the sub-component of the lamp connection unit with the largest surface area perpendicular to the longitudinal axis is located proximate to the power connection unite.

According to yet another exemplary embodiment of the present invention, a liquid crystal display includes a liquid crystal panel which displays an image signal, and a backlight assembly including at least one lamp, a housing unit which receives the at least one lamp and has socket holes corresponding to ends of the at least one lamp, and lamp sockets which are inserted into the socket holes and are connected to the at least one lamp, wherein each of the lamp sockets comprises a power connection unit which is electrically connected to an electric source which supplies power to a lamp, a lamp connection unit which is disposed above and adjacent to the power connection unit along a longitudinal axis and is electrically connected to the lamp, and a fastening member which is disposed on the lamp connection unit and is secured to the socket hole, wherein the lamp connection unit comprises at least one sub-component which has a surface area perpendicular to the longitudinal axis which is larger than the largest surface area of the power connection unit perpendicular to the longitudinal axis and wherein the sub-component of the lamp connection unit with the largest surface area perpendicular to the longitudinal axis is located proximate to the power connection unit which supplies light to the liquid crystal panel.

According to yet another exemplary embodiment of the present invention a method of manufacturing a lamp socket includes; forming a lamp connection unit which is electrically connected to a lamp, forming a power connection unit which is disposed below and adjacent to the lamp connection unit along a longitudinal axis and is electrically connected to an electric source which supplies power to the lamp, and forming a fastening member which is disposed on the power connection unit, wherein the forming a power connection unit comprises forming at least one sub-component to have a surface area perpendicular to the longitudinal axis which is larger than the largest surface area of the lamp connection unit perpendicular to the longitudinal axis and wherein the sub-component of the power connection unit with the largest surface area perpendicular to the longitudinal axis is formed proximate to the lamp connection unit.

According to yet another exemplary embodiment of the present invention a method of manufacturing a lamp socket includes; forming a power connection unit which is electrically connected to an electric source which supplies power to a lamp, forming a lamp connection unit which is disposed above and adjacent to the power connection unit along a longitudinal axis and is electrically connected to the lamp, and forming a fastening member which is disposed on the lamp connection unit, wherein the forming a lamp connection unit comprises forming at least one sub-component to have a surface area perpendicular to the longitudinal axis which is larger than the largest surface area of the power connection unit perpendicular to the longitudinal axis and wherein the sub-component of the lamp connection unit with the largest surface area perpendicular to the longitudinal axis is formed proximate to the power connection unit.

BRIEF DESCRIPTION OF THE DRAWINGS

The above and other aspects, features and advantages of the present invention will become more apparent by describing in more detail exemplary embodiments thereof with reference to the attached drawings in which.

DETAILED DESCRIPTION OF THE INVENTION

Figure 1:
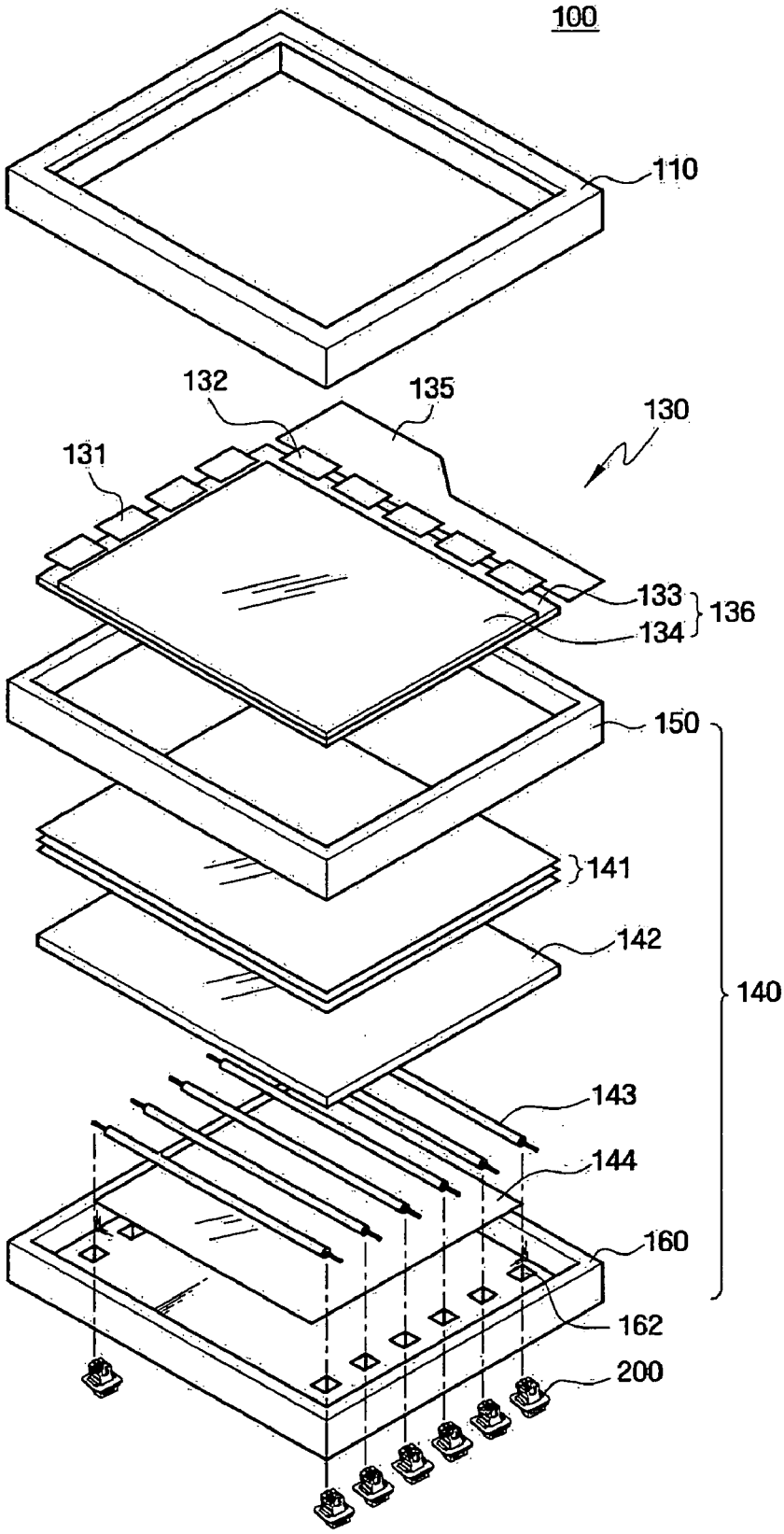
FIG. 1 is an exploded perspective view illustrating a first exemplary embodiment of a liquid crystal display according to the present invention.

Aspects, advantages and features of the present invention and methods of accomplishing the same may be understood more readily by reference to the following detailed description of preferred embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Like reference numerals refer to like elements throughout the specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, exemplary embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

A first exemplary embodiment of a lamp socket according to the present invention, an exemplary embodiment of a backlight assembly including the lamp socket, and an exemplary embodiment of a liquid crystal display including the backlight assembly will now be described more fully with reference to FIGS. 1 through 8.

FIG. 1 is an exploded perspective view illustrating a first exemplary embodiment of a liquid crystal display 100 according to the present invention. Referring to FIG. 1, a liquid crystal display 100 includes a liquid crystal panel assembly 130, a backlight assembly 140, and an upper housing unit 110.

The liquid crystal panel assembly 130 includes a liquid crystal panel 136 including a thin film transistor ("TFT") array panel 133 and a common electrode panel 134, liquid crystals (not shown), gate tape carrier packages 131, data tape carrier packages 132, and a printed circuit board 135.

In the liquid crystal panel 136, the TFT array panel 133 includes gate lines (not shown), data lines (not shown), an array of TFTs (not shown), pixel electrodes (not shown), and other various components. The common electrode panel 134 includes black matrices (not shown), a common electrode (not shown), and other various components, and is disposed opposite to the TFT array panel 133.

The gate tape carrier packages 131 are respectively connected to the gate lines in the TFT array panel 133, and the data tape carrier packages 132 are respectively connected to the data lines in the TFT array panel 133.

In one exemplary embodiment driving devices for processing gate driving signals and data driving signals are mounted on the printed circuit board 135 to apply the gate driving signals and the data driving signals to the gate tape carrier packages 131 and the data tape carrier packages 132, respectively. Alternative exemplary embodiments include configurations wherein the driving devices are mounted on the TFT array panel 133.

The backlight assembly 140 includes optical sheets 141, an optical plate 142, lamps 143, and a reflective plate 144.

The lamps 143 may be light emitting diodes ("LEDs"), cold cathode fluorescent lamps ("CCFLs"), external electrode fluorescent lamps ("EEFLs"), or various other types of light emitting devices. The lamps 143 generate light using a lamp driving voltage applied to the lamps 143 from an external source (not shown). According to the present exemplary embodiment the lamps 143 are spaced apart from each other by a predetermined distance and positioned in parallel to each other in the same plane. The lamps 143 may form a structure which supplies light directly to the liquid crystal panel 136. In order to achieve uniformity of brightness by uniformly distributing a discharge gas in the lamps 143, the lamps 143 may be arranged horizontally with respect to the liquid crystal panel 136. Lamp sockets 200 are securely inserted into socket holes 162 formed in a lower housing unit 160. The lamp sockets 200 are positioned to correspond to end portions of the lamps 143 and securely support the lamps 143. The lamp sockets 200 will be descried in more detail below.

The optical plate 142 may be disposed on the lamps 143, and serves to enhance the brightness uniformity of light generated from the lamps 143. The optical plate enables a more uniform distribution of light to the liquid crystal panel 136.

The reflective plate 144 is disposed below the lamps 143 and reflects light upward from below the lamps 143. In one exemplary embodiment the reflective plate 144 may be formed integrally with the bottom surface of the lower housing unit 160. If the lower housing unit 160 is made of a highly reflective material, exemplary embodiments of which include aluminum (Al) or aluminum alloy, the lower housing unit 160 itself can serve as the reflective plate 144.

The optical sheets 141 are disposed on the optical plate 142, and serve to diffuse and focus light coming from the lamps 143. Exemplary embodiments of the optical sheets 141 include a diffusion sheet, a first prism sheet, a second prism sheet, and various other sheets with similar properties.

In the exemplary embodiment wherein the optical sheets include a diffusion sheet, the diffusion sheet is disposed above the lamps 143 and serves to enhance the brightness and brightness uniformity of incident light from the lamps 143.

In the exemplary embodiment wherein the optical sheets include a prism sheet, the first prism sheet is disposed on the diffusion sheet. Exemplary embodiments of the prism sheet include triagonal prism patterns (not shown) uniformly arranged on a surface of the first prism sheet to focus light diffused from the diffusion sheet and to output the focused light. In one exemplary embodiment the first prism sheet may be a brightness enhancement film ("BEF").

In the exemplary embodiment wherein the optical sheets include a prism sheet the second prism sheet is disposed on the first prism sheet, and is a multi-layered, reflective, polarization prism sheet for focusing, polarizing, and outputting light. In one exemplary embodiment the second prism sheet may be a dual brightness enhancement film ("DBEF"). In the exemplary embodiment where the first prism sheet provides sufficient brightness and viewing angle, the second prism sheet may be omitted.

The backlight assembly 140 includes a receiving frame 150 and the lower housing unit 160 for receiving the optical sheets 141, the optical plate 142, the lamps 143, and the reflective plate 144.

The liquid crystal panel assembly 130 is disposed on the optical sheets 141, and is received in the lower housing unit 160 in a state in which it is supported by the receiving frame 150. The receiving frame 150 has sidewalls extending from the edges of a bottom surface. In one exemplary embodiment the receiving frame 150 is structured such that the liquid crystal panel assembly 130 can be supported by stepped portions or projections formed inside the sidewalls. The lower housing unit 160 has a substantially flat bottom surface, and receives the optical sheets 141, the optical plate 142, the lamps 143, the reflective plate 144, and the liquid crystal panel assembly 130 in an area defined by sidewalls extending from the edges of its bottom surface. The lower housing unit 160 also serves to prevent bending of the optical sheets 141. In one exemplary embodiment the printed circuit board 135 of the liquid crystal panel assembly 130 is folded along an outer edge of the lower housing unit 160 so that it is disposed on a sidewall or a rear surface of the lower housing unit 160. The shape of the lower housing unit 160 can be changed according to how the optical sheets 141, the optical plate 142, the lamps 143, the reflective plate 144, or the liquid crystal panel assembly 130 are placed in the lower housing unit 160.

The lower housing unit 160 is coupled to the upper housing unit 110 so that a periphery of an upper surface of the liquid crystal panel assembly 130 received in the lower housing unit 160 is covered. A window for exposing the liquid crystal panel assembly 130 to the outside is disposed on an upper surface of the upper housing unit 110.

Exemplary embodiments of the coupling between the upper housing unit 110 and the lower housing unit 160 can be accomplished by hooking (not shown) and/or screwing (not shown). The coupling between the upper housing unit 110 and the lower housing unit 160 may also be achieved in various other ways.

Figure 2:
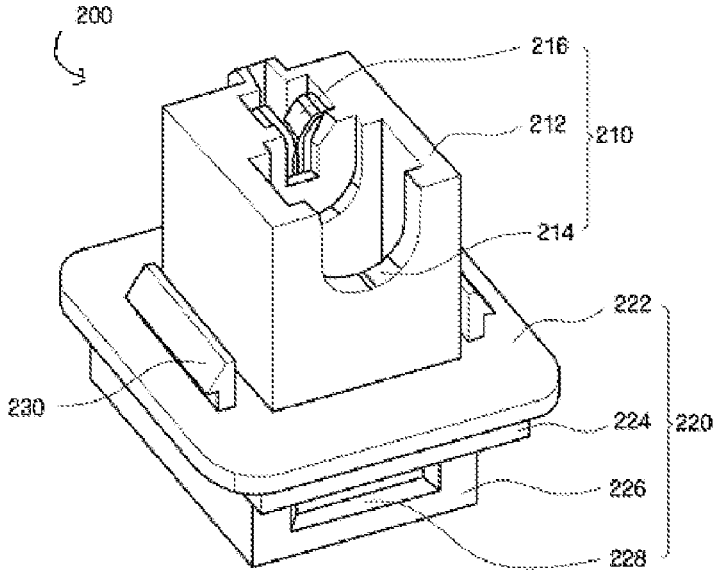
FIG. 2 is a top front perspective view illustrating a first exemplary embodiment of a lamp socket according to the present invention.
Figure 3:
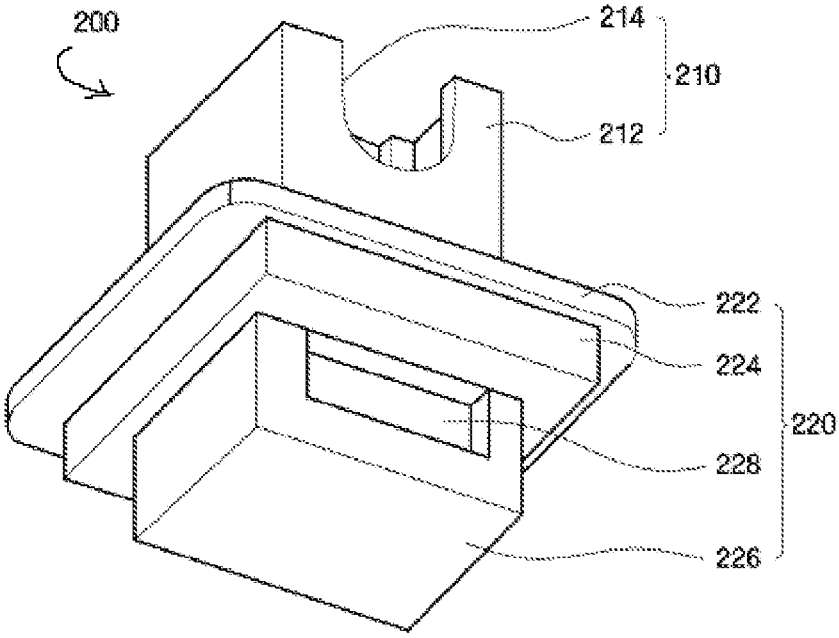
FIG. 3 is a perspective view, as seen from below, of the exemplary embodiment of the lamp socket of FIG. 2.
Figure 4:
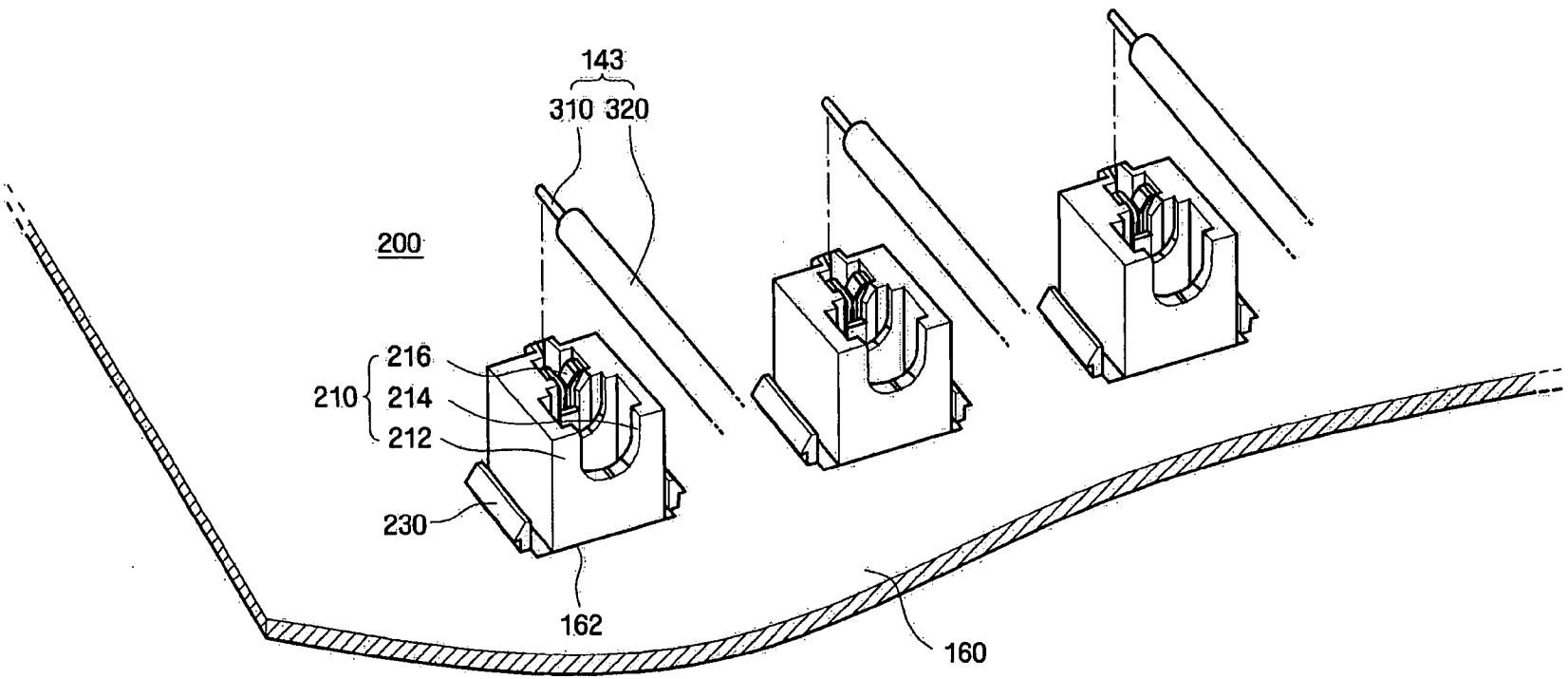
FIG. 4 is a top perspective view illustrating the assembly of an exemplary embodiment of a lower housing unit and a lamp with the exemplary embodiment of the lamp socket of FIG. 2.
Figure 5:
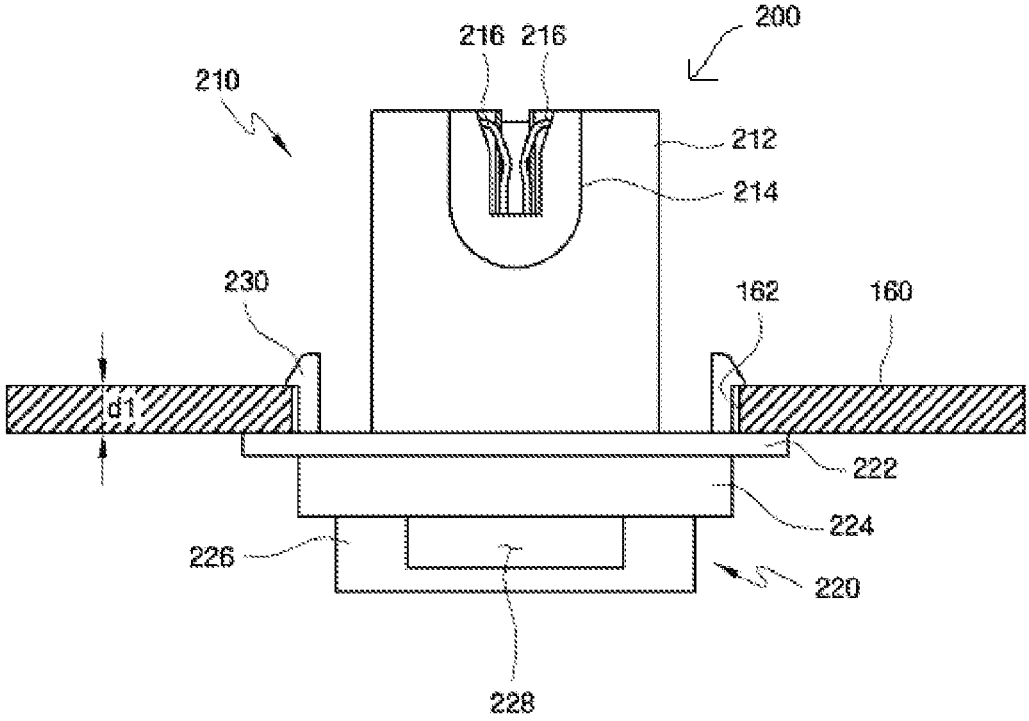
FIG. 5 is a front view illustrating an exemplary embodiment of a lower housing unit and the exemplary embodiment of the lamp socket of FIG. 2, in an assembled state.
Figure 6:
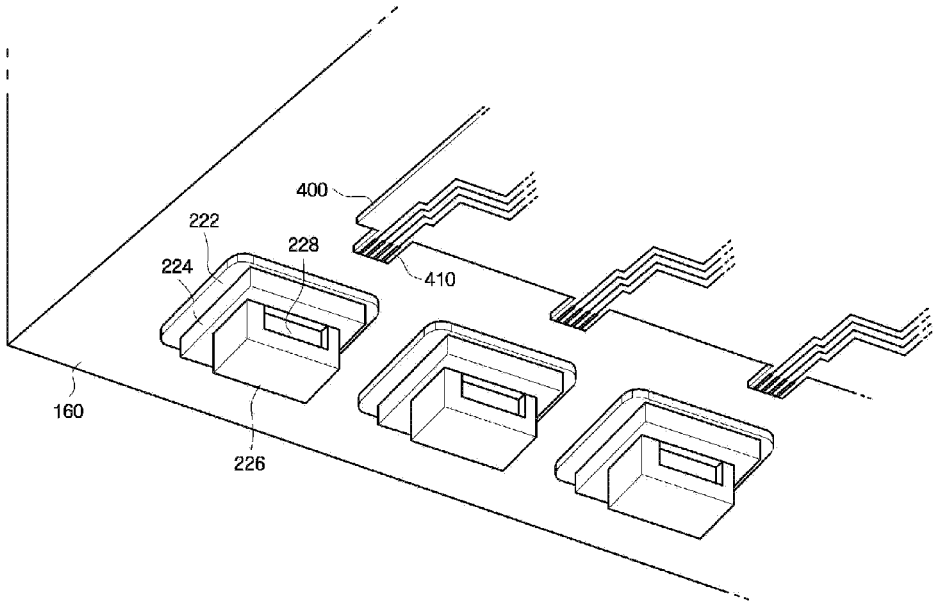
FIG. 6 is a front perspective view, as seen from below, illustrating an exemplary embodiment of a lower housing unit, an exemplary embodiment of an inverter printed circuit board, and the exemplary embodiment of the lamp socket of FIG. 2, in an assembled state.
Figure 7:
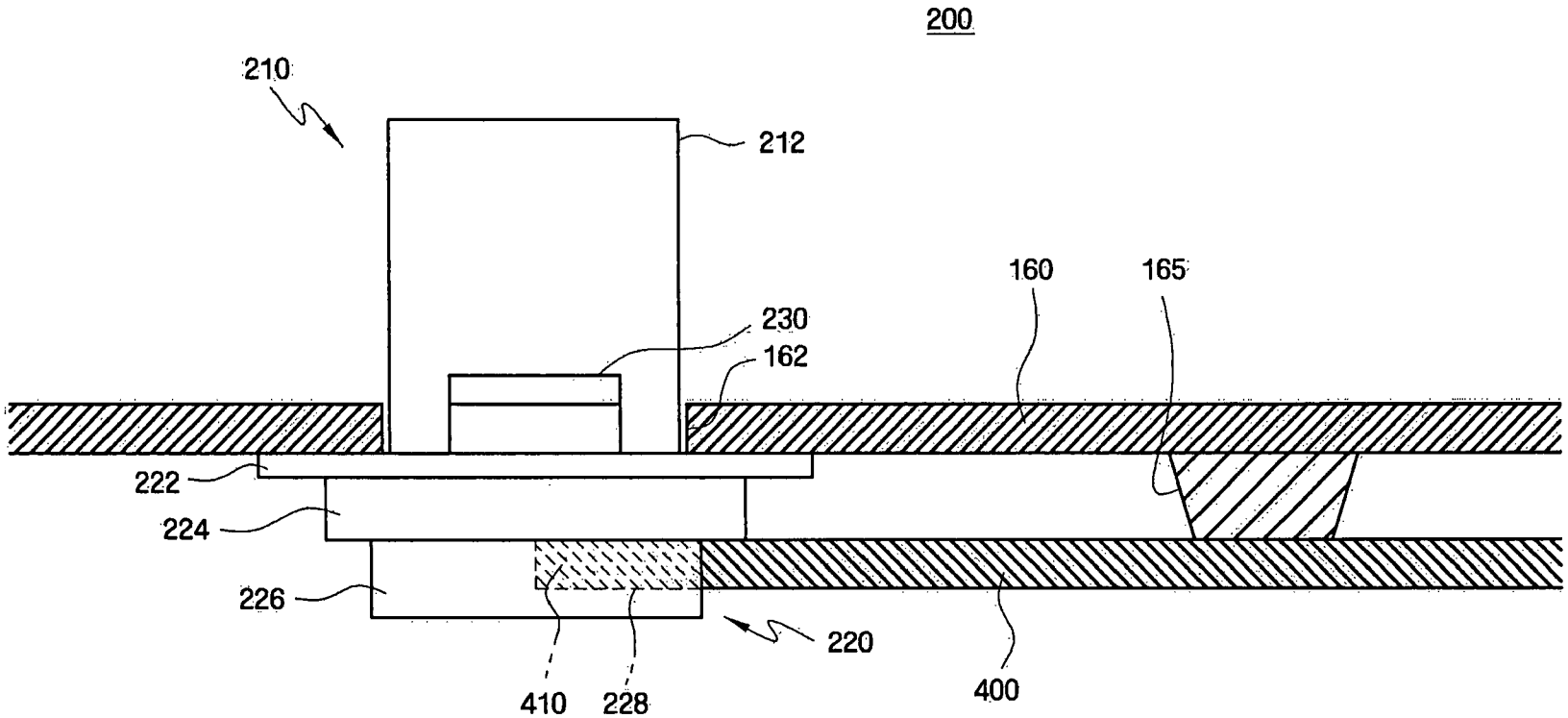
FIG. 7 is a side view illustrating an exemplary embodiment of a lower housing unit, an exemplary embodiment of an inverter printed circuit board, and the exemplary embodiment of the lamp socket of FIG. 2 in an assembled state.

Hereinafter, an exemplary embodiment of a lamp socket according to the present invention will be described in more detail with reference to FIGS. 2 through 7. FIG. 2 is a top front perspective view illustrating a first exemplary embodiment of a lamp socket (200) according to the present invention, FIG. 3 is a front perspective view, as seen from below, of the exemplary embodiment of a lamp socket of FIG. 2, FIG. 4 is a top front perspective view illustrating the assembly of an exemplary embodiment of the lower housing unit and a lamp with the exemplary embodiment of the lamp socket of FIG. 2, FIG. 5 is a front view illustrating an exemplary embodiment of the lower housing unit and the exemplary embodiment of the lamp socket of FIG. 2, in an assembled state, FIG. 6 is a front perspective view, as seen from below, illustrating an exemplary embodiment of the lower housing unit, an exemplary embodiment of an inverter printed circuit board, and the exemplary embodiment of the lamp socket of FIG. 2, in an assembled state, and FIG. 7 is a side view illustrating an exemplary embodiment of a lower housing unit, an exemplary embodiment of the inverter printed circuit board, and the exemplary embodiment of the lamp socket of FIG. 2, in an assembled state.

First, referring to FIGS. 2 and 3, together with FIG. 1, the lamp socket 200 includes a lamp connection unit 210 which is electrically connected to the lamp 143, a power connection unit 220 which is disposed below the lamp connection unit 210 and electrically connected to a power source (not shown) for supplying power to the lamp 143, and a fastening member 230, which is disposed on the power connection unit 220 at the boundary between the lamp connection unit 210 and the power connection unit 220 and secures the lamp socket 200 to the lower housing unit 160.

The lamp connection unit 210 includes a first housing 212 made of an insulating material, a guide groove 214 formed in the first housing 212 to permit the lamp 143 to be inserted into the first housing 212, and a lamp connection terminal 216 to electrically connect to the lamp 143. The lamp connection terminal 216 has a pair of convexly curved opposing surfaces and is made of a conductive material. The lamp connection terminal 216 is electrically connected to the lamp 143 by elastically and securely gripping the lamp 143.

The power connection unit 220 includes a stepped structure protruding outwardly with respect to the lamp connection unit 210 and adjoining the lamp connection unit 210. The power connection unit 220 may be electrically connected to an inverter printed circuit board for supplying power. In more detail, the power connection unit 220 includes a light-shielding plate 222 constituting the bottom portion of the stepped structure, a board support 224 disposed below the light-shielding plate 222, a second housing 226 disposed below the board support 224, and a power connection terminal 228 which is disposed in the second housing 226 and electrically may be connected to the inverter printed circuit board.

The light-shielding plate 222 adjoins the lamp connection unit 210 and constitutes the bottom portion of the stepped structure. The fastening member 230 is disposed on the side of the light-shielding plate opposite the board support. The fastening member 230 extends upward away from the stepped structure of the power connection unit 220. Therefore, as shown in FIGS. 4 and 5, the lamp socket 200 can be easily and securely inserted into the socket hole 162 of the lower housing unit 160 using the fastening member 230 disposed on the light-shielding plate 222 without using an additional fastener. In one exemplary embodiment the fastening member 230 may have a hook-like shape with an outwardly protruding portion. One or more fastening members may be disposed on the light-shielding plate 222. In the present exemplary embodiment, two fastening members are disposed to be opposite to each other with respect to the lamp connection unit 210. Alternative exemplary embodiments include configurations wherein only one fastening member 230 or more than two fastening members 230 are used. Meanwhile, in order to prevent external light from passing through the socket hole 162, light-shielding plate 222 may have a larger area than the socket hole 162.

As shown in FIGS. 6 and 7, a portion of the inverter printed circuit board is inserted into the power connection terminal 228 disposed in the second housing 226, and the power connection terminal 228 is electrically connected to the lamp connection terminal 216 through the pair of convexly curved opposing surfaces made of a conductive material which run internally through the lamp socket down from the lamp connection terminal in the lamp connection unit to the power connection terminal in the power connection unit. Thus, lamp power from the inverter printed circuit board is supplied through the power connection terminal 228 and the lamp connection terminal 216 and into the lamp 143.

The board support 224 interposed between the power connection terminal 228 and the light-shielding plate 222 serves to support the inverter printed circuit board inserted into the power connection terminal 228.

Referring again to FIGS. 4 and 5, when the lamp socket 200 is inserted upward into the socket hole 162, it is secured to the lower housing unit 160 by the fastening member 230 disposed on the power connection unit 220. The lamp connection unit 210 of the lamp socket 200 is disposed inside the lower housing unit 160, and the power connection unit 220 of the lamp socket 200 is disposed outside the lower housing unit 160.

Next, the lamp 143 is inserted into the lamp connection unit 210, which has been insertedly disposed in the lower housing unit 160, to electrically connect the lamp 143 to the lamp connection unit 210.

The lamp 143 includes a lamp tube 320 internally coated with a fluorescent material and lead lines 310 connected to both ends of the lamp tube 320. Exemplary embodiments of the fluorescent material coated in the lamp tube 320 include a rare earth element with high fluorescence efficiency, e.g., yttrium (Y), cerium (Ce), or terbium (Tb). In one exemplary embodiment the lamp 143 may be a three-wavelength type fluorescent lamp made of red, green, and blue fluorescent materials. The lead lines 310 supply an external power to electrodes (not shown) disposed inside the lamp tube 320.

When the lamp tube 320 of the lamp 143 is inserted along the guide groove 214 of the lamp connection unit 210, the lamp connection terminal 216 of the lamp connection unit 210 is connected to the lead line 310 of the lamp 143.

Referring to FIGS. 6 and 7, with respect to the lamp socket 200 securely inserted into a socket hole 162 by the fastening member 230, a pad 410 of an inverter printed circuit board 400 disposed below the lower housing unit 160 is electrically connected to the lamp socket 200 by inserting the pad 410 into the power connection terminal 228 of the lamp socket 200. Heat may be generated from any of several devices (e.g., a transformer) mounted on the inverter printed circuit board 400. Thus, the inverter printed circuit board 400 may be disposed to be separated from the lower housing unit 160 by a predetermined distance.

Accordingly, the power connection terminal 228 connected to the pad 410 of the inverter printed circuit board 400 may be disposed to be separated from the light-shielding plate 222 by a predetermined distance determined by the spacing between the lower housing unit 160 and the inverter printed circuit board 400. Furthermore, in order to support the inverter printed circuit board 400 inserted into the power connection terminal 228, the board support 224 may be interposed between the power connection terminal 228 and the light-shielding plate 222. In addition, an auxiliary projection 165 for supporting the inverter printed circuit board 400 may be disposed on a lower surface of the lower housing unit 160. In another exemplary embodiment, the auxiliary projection 165 may be disposed on an upper surface of the inverter printed circuit board 400.

Figure 8:
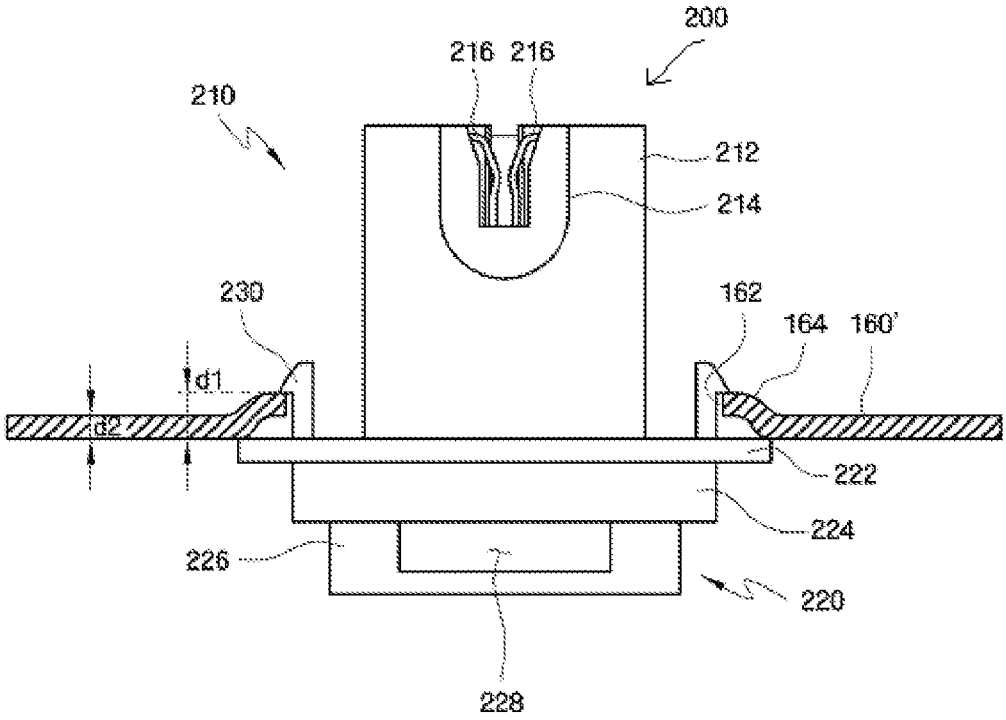
FIG. 8 is a front view illustrating an exemplary embodiment of a lower housing unit with a relatively thin thickness and an exemplary embodiment of the lamp socket of FIG. 2, in an assembled state.

Hereinafter, the application of a lamp socket to different types of lower housing units with different thicknesses will be described with reference to FIGS. 5 and 8. FIG. 8 is a front view illustrating an exemplary embodiment of a lower housing unit having a relatively thin thickness and an exemplary embodiment of the lamp socket of FIG. 2, in an assembled state.

First, referring to FIG. 5 illustrating the lamp socket 200 securely inserted into the socket hole 162 of the lower housing unit 160, the position of a protruding portion of the fastening member 230 is determined by the thickness d1 of the lower housing unit 160. In the exemplary embodiment shown in FIG. 8, when the lamp socket 200 is inserted into a lower housing unit 160' with a thinner thickness d2 than the thickness d1, the thickness d2 of the lower housing unit 160' is thinner than a gap between the protruding portion and the light-shielding plate 222, and thus, the lamp socket 200 may not be secured to the lower housing unit 160'. In this regard, as shown in FIG. 8, an embossing 164 is formed around a socket hole 162 of the lower housing unit 160', to enable the lamp socket 200 to be securely fastened to the lower housing unit 160'.

The first housing 212, the light-shielding plate 222, the board support 224, and the second housing 226 constituting the lamp connection unit 210 or the power connection unit 220 have been separately described and can be formed separately as in the above-described exemplary embodiment of the present invention. However, alternative exemplary embodiments include configurations wherein all or some of the components constituting the lamp connection unit 210 or the power connection unit 220 may also be formed integrally with each other.

Figure 9A:
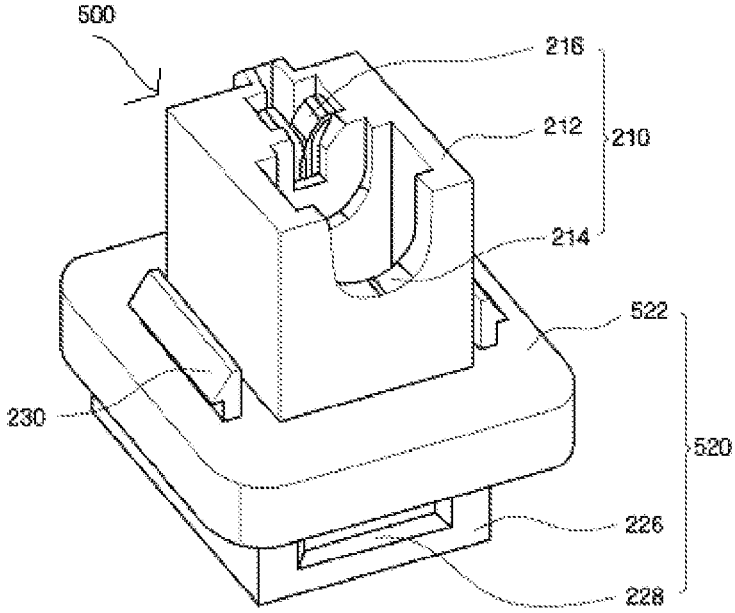
FIG. 9A is a top front perspective view illustrating a second exemplary embodiment of a lamp socket according to the present invention.
Figure 9B:
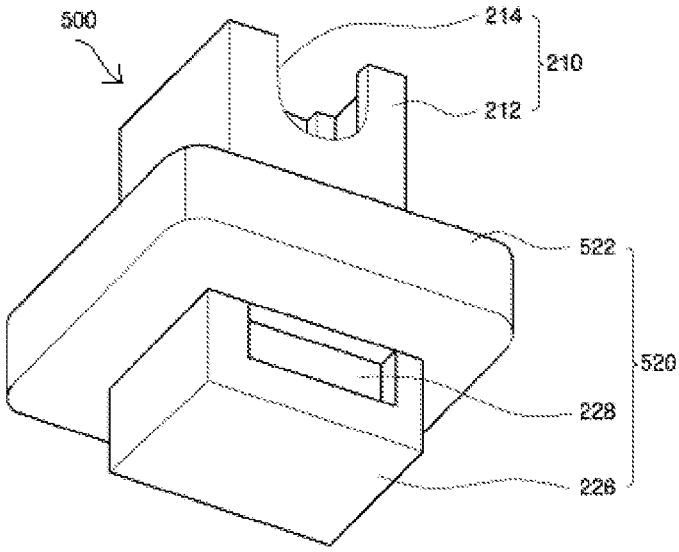
FIG. 9B is a front perspective view, as seen from below, of the exemplary embodiment of the lamp socket of FIG. 9A.
Figure 9C:
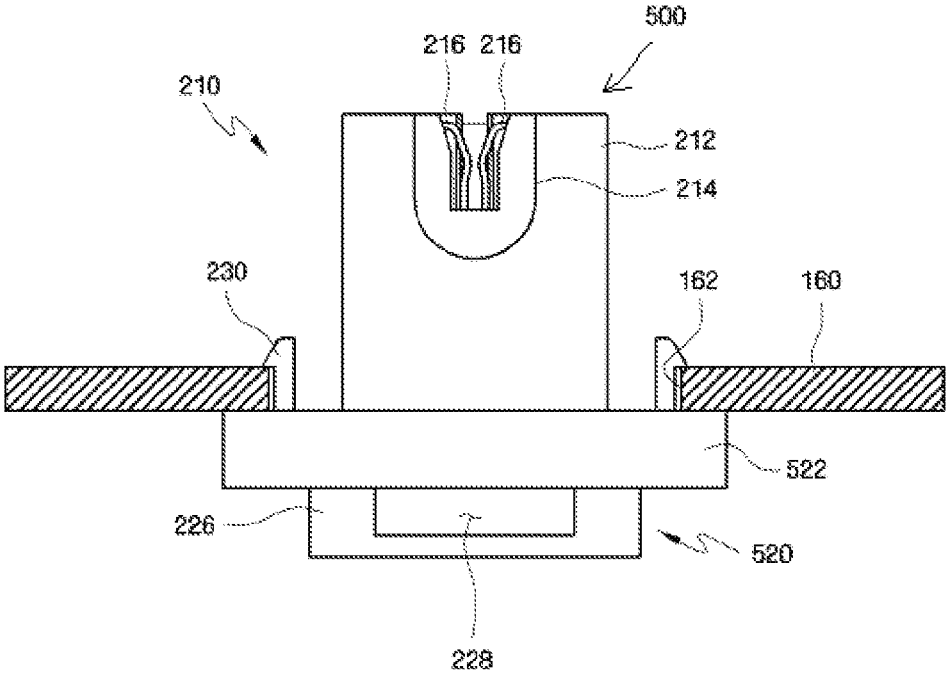
FIG. 9C is a front view illustrating an exemplary embodiment of a lower housing unit and the second exemplary embodiment of the lamp socket of FIG. 9A, in an assembled state.
Figure 9D:
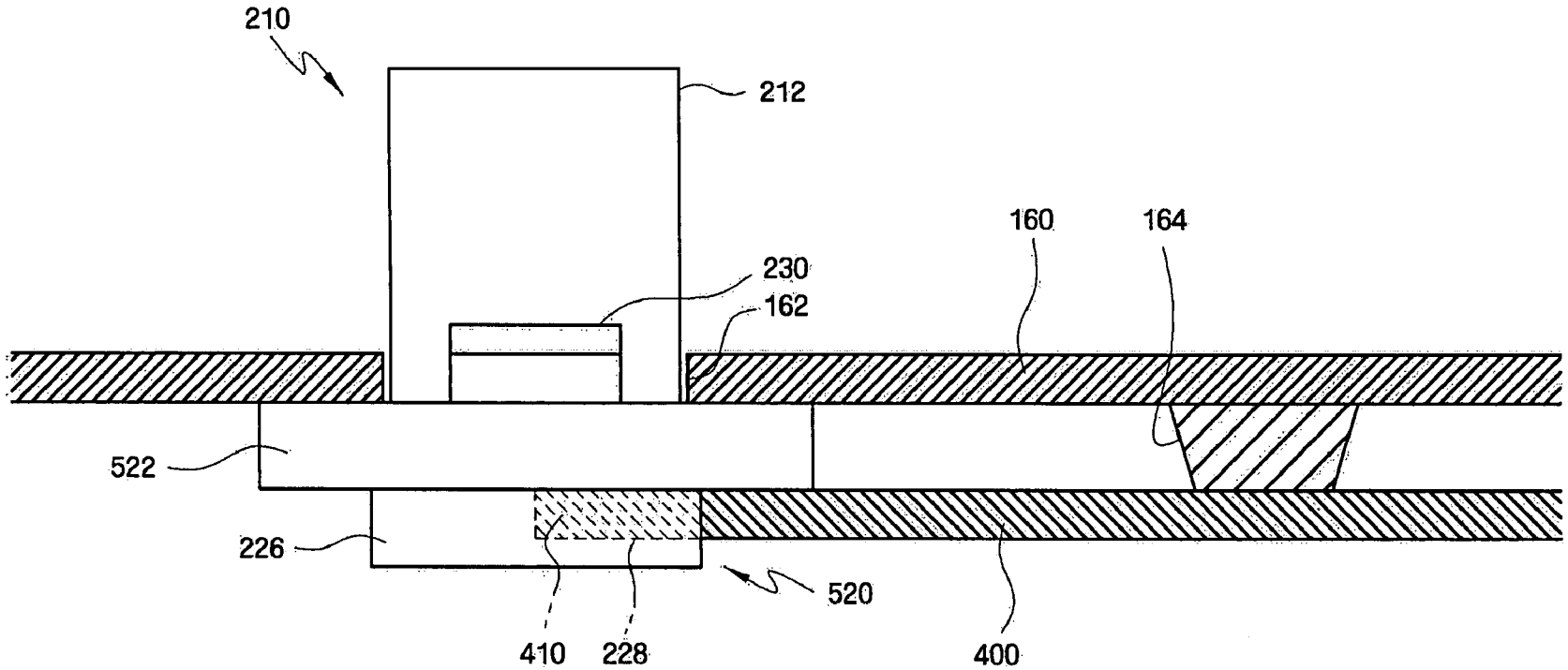
FIG. 9D is a side view illustrating an exemplary embodiment of a lower housing unit, an exemplary embodiment of an inverter printed circuit board, and the second exemplary embodiment of the lamp socket of FIG. 9A, in an assembled state.

Hereinafter, a second exemplary embodiment of a lamp socket according to the present invention will be described in more detail with reference to FIGS. 9A through 9D. FIG. 9A is a top front perspective view illustrating a second exemplary embodiment of a lamp socket 500 according to the present invention, FIG. 9B is a front perspective view, as seen from below, of the exemplary embodiment of a lamp socket of FIG. 9A, FIG. 9C is a front view illustrating an exemplary embodiment of a lower housing unit and the second exemplary embodiment of the lamp socket of FIG. 9A, in an assembled state, and FIG. 9D is a side view illustrating an exemplary embodiment of a lower housing unit, an exemplary embodiment of an inverter printed circuit board, and the second exemplary embodiment of the lamp socket of FIG. 9A, in an assembled state. For convenience of illustration, the same functional elements as those in the first exemplary embodiment, shown in FIGS. 2 through 8, are represented by the same reference numerals, and thus, a detailed description thereof will be omitted. The second exemplary embodiment of a lamp socket of the present invention has substantially the same structure as that of the first exemplary embodiment of the present invention except for the points described below.

Referring to FIGS. 9A through 9D, a power connection unit 520 of a second exemplary embodiment of a lamp socket 500 includes a light-shielding plate 522 which constitutes a stepped structure protruding outwardly with respect to a lamp connection unit 210 and adjoining the lamp connection unit 210, a second housing 226 which is disposed on a lower surface of the light-shielding plate 522, and a power connection terminal 228 which is disposed in the second housing 226 and which may be electrically connected to an inverter printed circuit board 400. A fastening member 230 is disposed on the light-shielding plate 522. When the second exemplary embodiment of a lamp socket 500 is inserted into a socket hole 162, the light-shielding plate 522 can serve to prevent the incidence of external light through the socket hole 162. The second exemplary embodiment of a lamp socket 500 is structured such that the light-shielding plate 522 supports the inverter printed circuit board 400. This second exemplary embodiment differs from the first exemplary embodiment in that the light-shielding plate 522 provides support for the inverter printed circuit board 400, whereas the first exemplary embodiment requires a board support 224 to perform the same function.

Figure 10A:
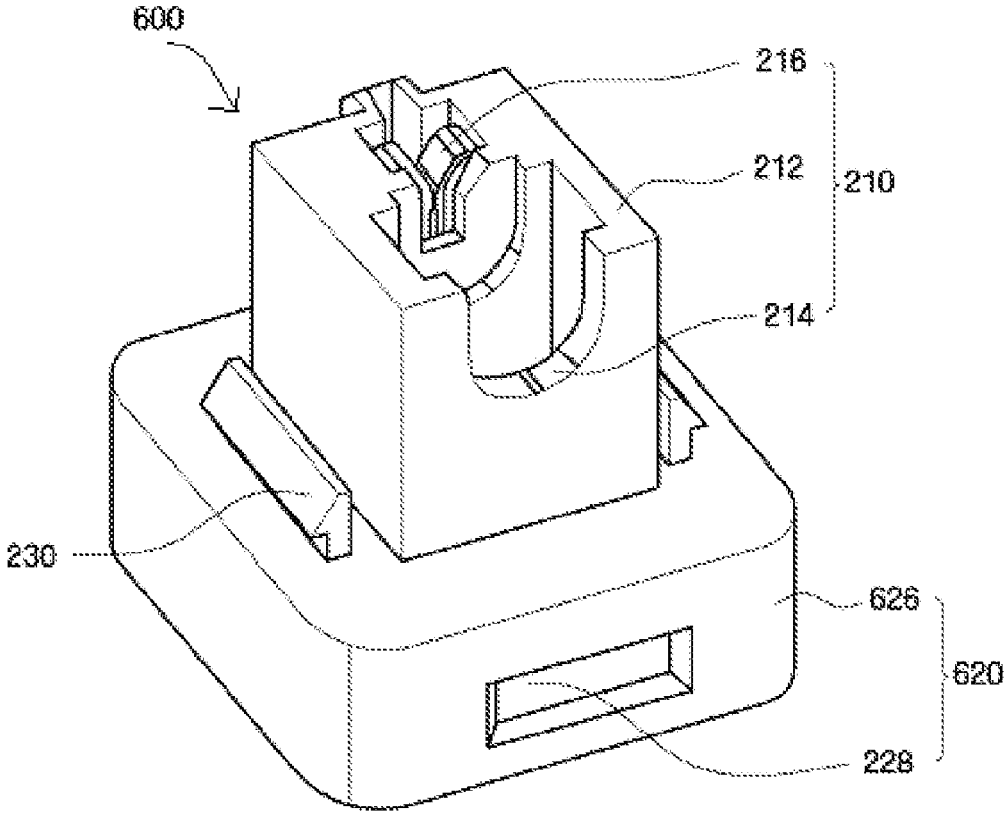
FIG. 10A is a top front perspective view illustrating a third exemplary embodiment of a lamp socket according to the present invention.
Figure 10B:
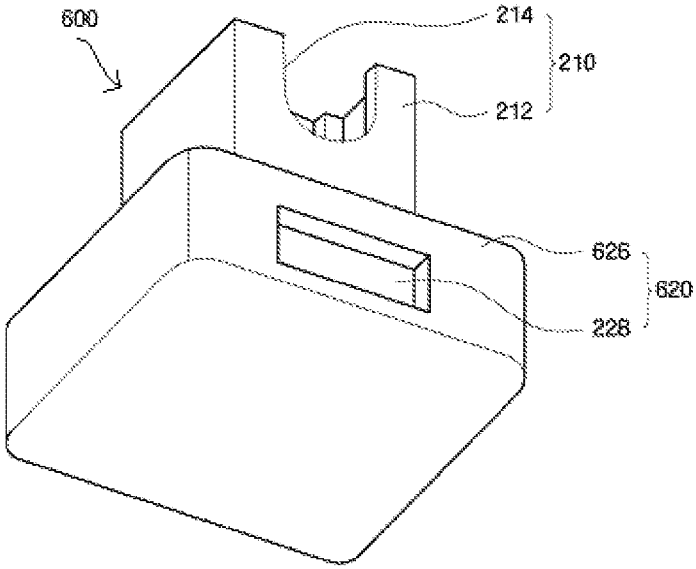
FIG. 10B is a front perspective view, as seen from below, of the third exemplary embodiment of the lamp socket of FIG. 10A.
Figure 10C:
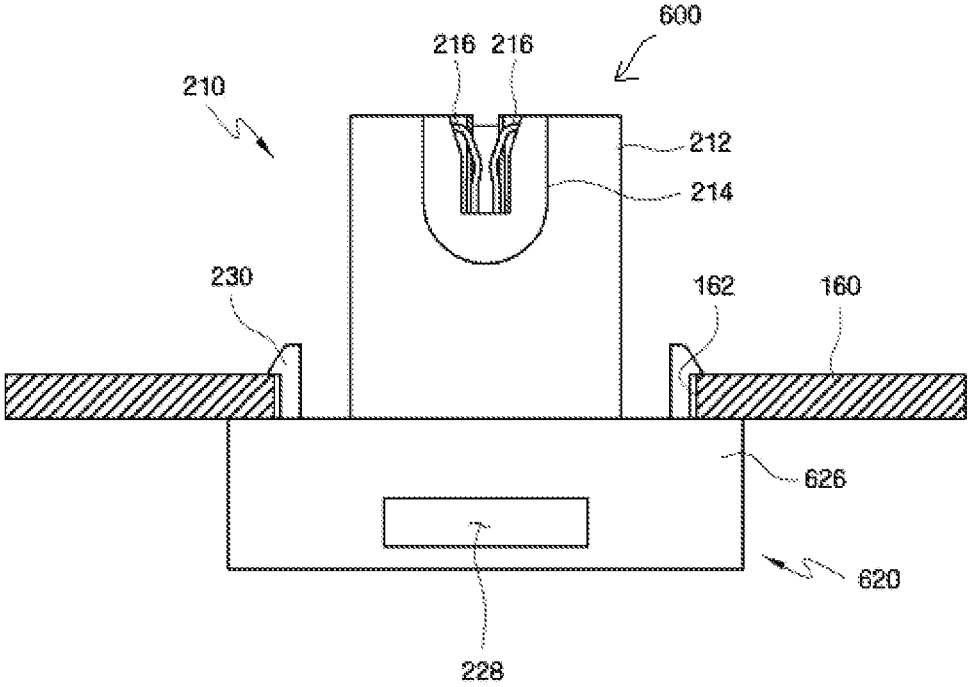
FIG. 10C is a front view illustrating an exemplary embodiment of a lower housing unit and the third exemplary embodiment of the lamp socket of FIG. 10A, in an assembled state.
Figure 10D:
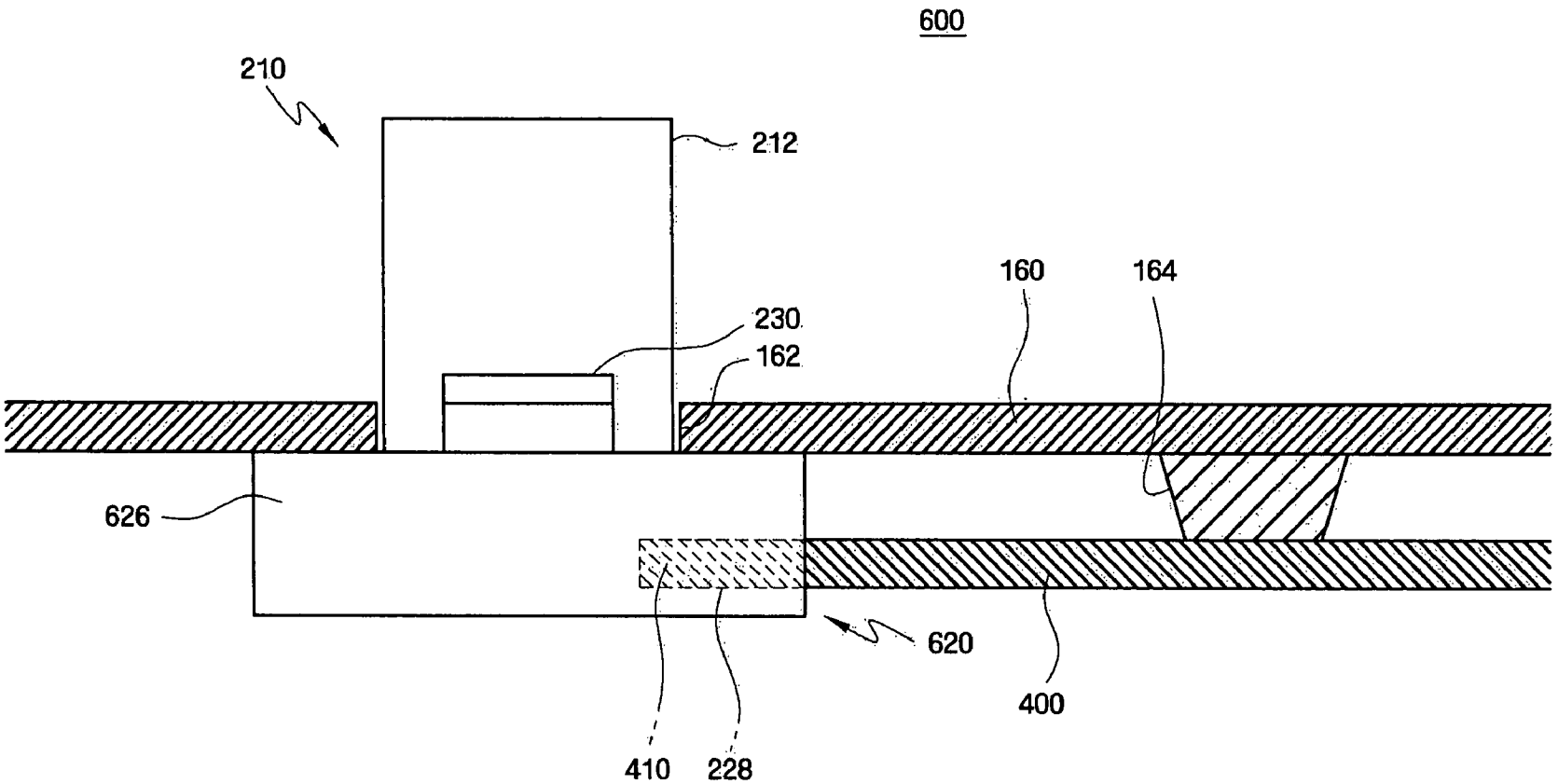
FIG. 10D is a side view illustrating an exemplary embodiment of a lower housing unit, an exemplary embodiment of an inverter printed circuit board, and the third exemplary embodiment of the lamp socket of FIG. 10A, in an assembled state.

Hereinafter, a third exemplary embodiment of a lamp socket according to the present invention will be described in more detail with reference to FIGS. 10A through 10D. FIG. 10A is a top front perspective view illustrating a third exemplary embodiment of a lamp socket 600 according to the present invention, FIG. 10B is a front perspective view, as seen from below, of the third exemplary embodiment of the lamp socket of FIG. 10A, FIG. 10C is a front view illustrating an exemplary embodiment of a lower housing unit and the third exemplary embodiment of the lamp socket of FIG. 10A, in an assembled state, FIG. 10D is a side view illustrating an exemplary embodiment of a lower housing unit, an exemplary embodiment of an inverter printed circuit board, and the third exemplary embodiment of the lamp socket of FIG. 10A, in an assembled state. For convenience of illustration, the same functional elements as those in the first exemplary embodiment, shown in FIGS. 2 through 8, are represented by the same reference numerals, and thus, a detailed description thereof will be omitted. The third exemplary embodiment of a lamp socket of the present invention has substantially the same structure as that of the first exemplary embodiment of the present invention except for the points described below.

Referring to FIGS. 10A through 10D, a power connection unit 620 of a third exemplary embodiment of a lamp socket 600 includes a second housing 626 which protrudes outwardly with respect to a lamp connection unit 210 and adjoins the lamp connection unit 210, and a power connection terminal 228 which is disposed in the second housing 626 and may be electrically connected to an inverter printed circuit board 400. A fastening member 230 is disposed on the second housing 626. When the third exemplary embodiment of a lamp socket 600 is inserted into a lamp hole 162, the second housing 626 can serve to prevent the incidence of external light through the socket hole 162. The third exemplary embodiment of a lamp socket 600 is structured such that the second housing 626 supports the inverter printed circuit board 400. This third exemplary embodiment of a light socket 600 differs from the first exemplary embodiment of a light socket 200 in that the second housing 626 provides support for the inverter printed circuit board 400, whereas the first exemplary embodiment of a light socket 200 requires a board support 224 to perform the same function.

Figure 11A:
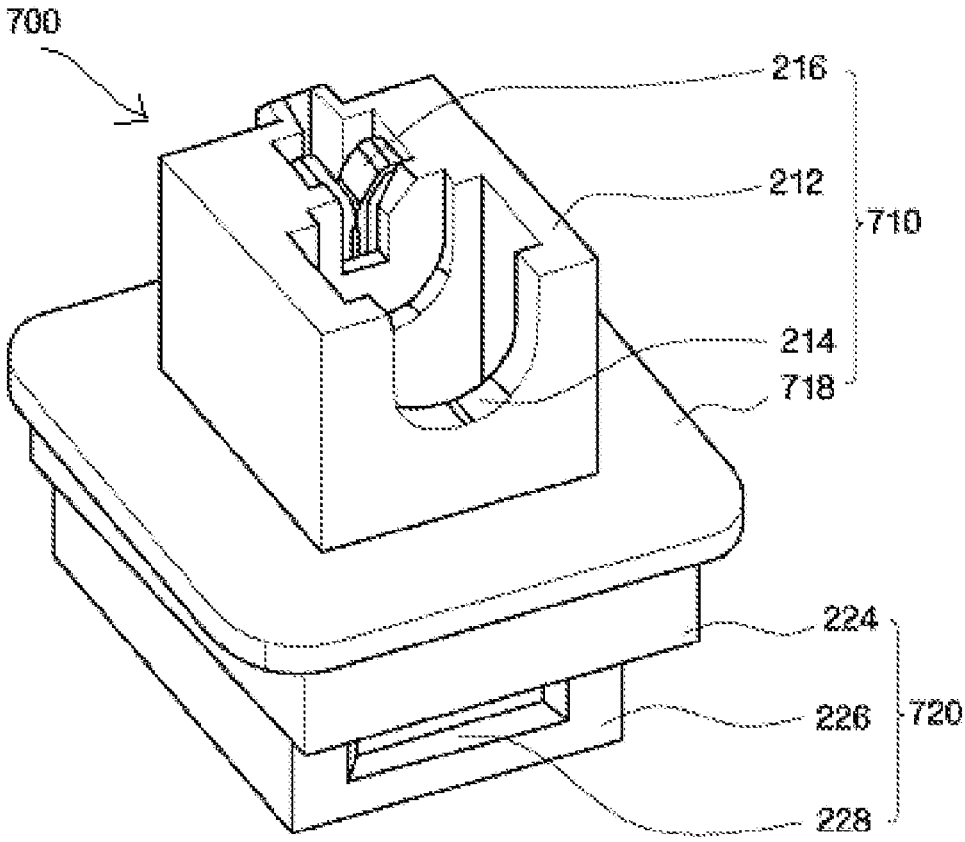
FIG. 11A is a top front perspective view illustrating a fourth exemplary embodiment of a lamp socket according the present invention.
Figure 11B:
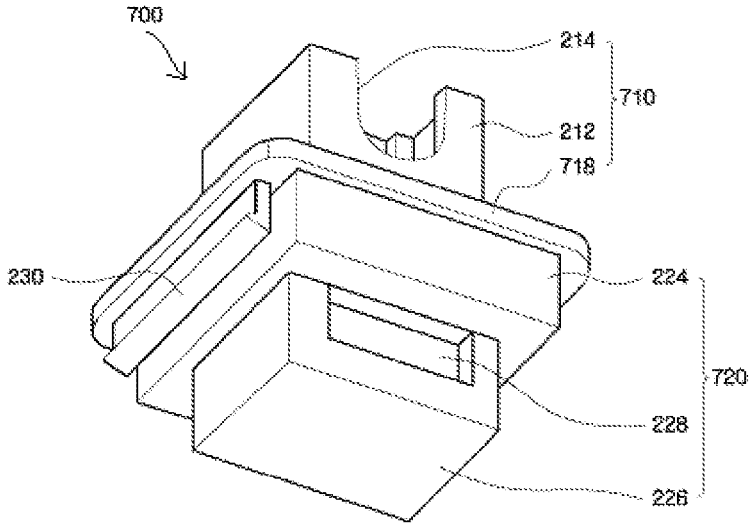
FIG. 11B is a front perspective view, as seen from below, of the fourth exemplary embodiment of the lamp socket of FIG. 11A.
Figure 11C:
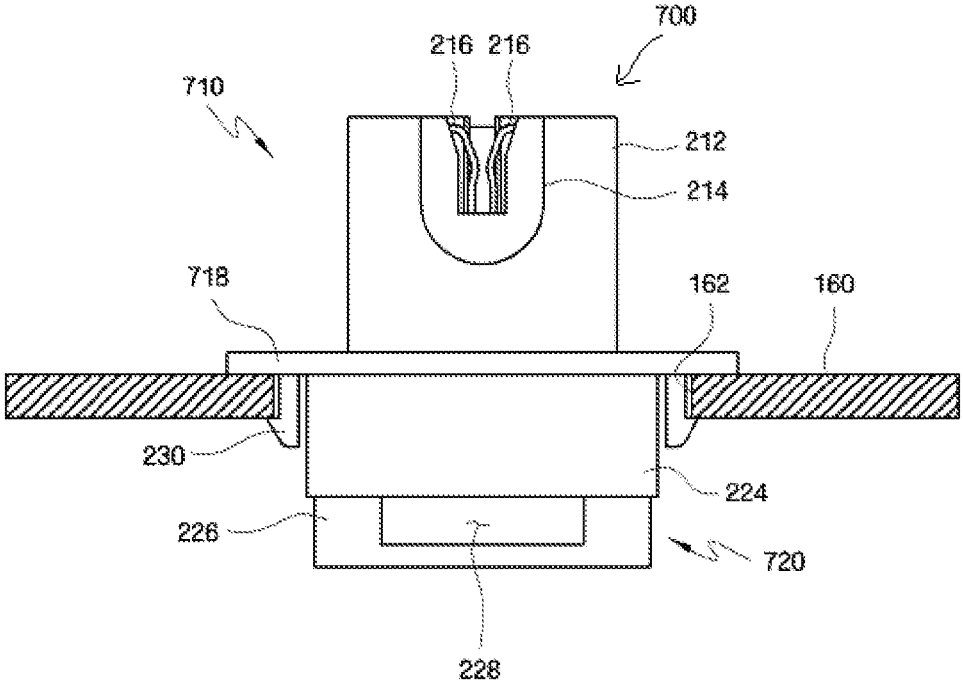
FIG. 11C is a front view illustrating an exemplary embodiment of a lower housing unit and the fourth exemplary embodiment of the lamp socket of FIG. 11A, in an assembled state.
Figure 11D:
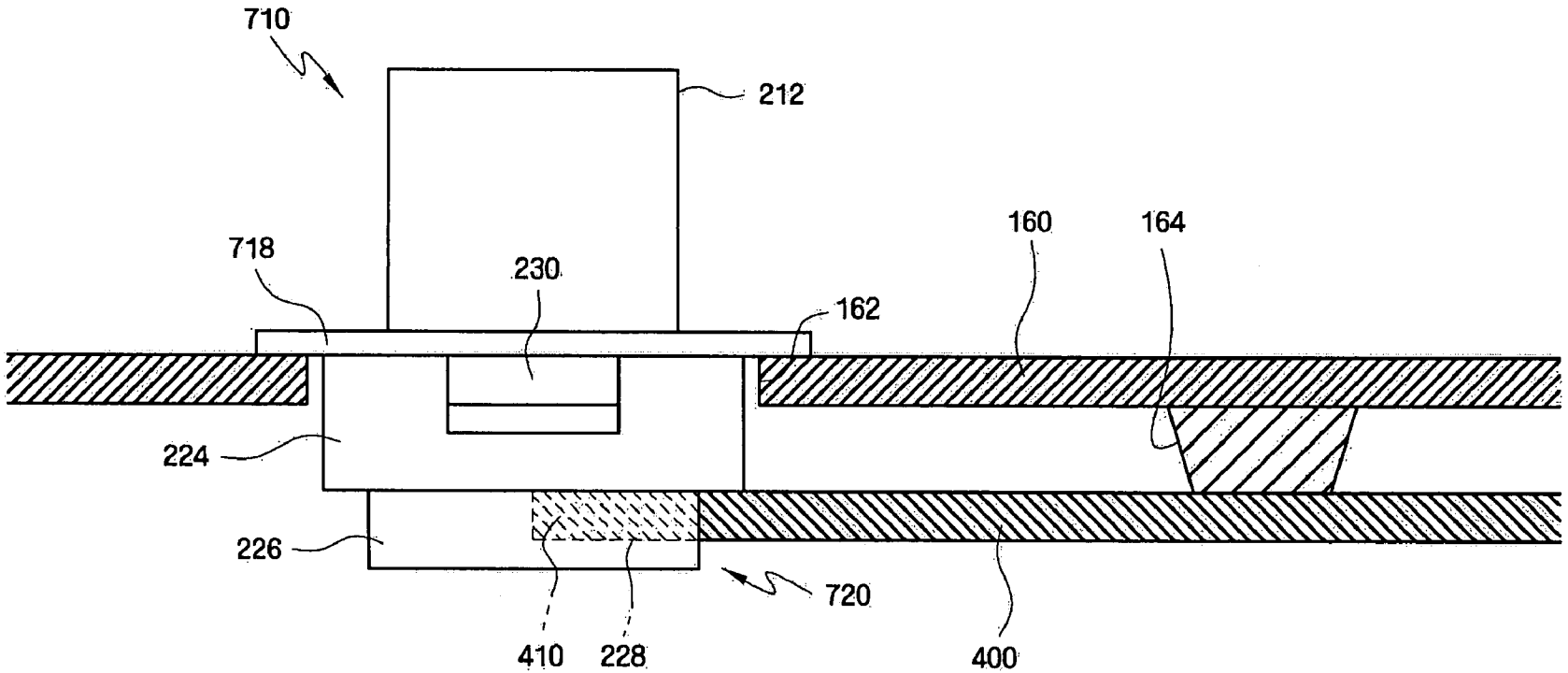
FIG. 11D is a side view illustrating an exemplary embodiment of a lower housing unit, an exemplary embodiment of an inverter printed circuit board, and the fourth exemplary embodiment of the lamp socket of FIG. 11A, in an assembled state.

Hereinafter, a fourth exemplary embodiment of a lamp socket according to the present invention will be described in more detail with reference to FIGS. 11A through 11D. FIG. 11A is a top front perspective view illustrating a fourth exemplary embodiment of a lamp socket 700 according to the present invention, FIG. 11B is a front perspective view, as seen from below, of the fourth exemplary embodiment of a lamp socket of FIG. 11A, FIG. 11C is a front view illustrating an exemplary embodiment of a lower housing unit and the fourth exemplary embodiment of the lamp socket of FIG. 11A, in an assembled state, and FIG. 11D is a side view illustrating an exemplary embodiment of a lower housing unit, an exemplary embodiment of an inverter printed circuit board, and the fourth exemplary embodiment of the lamp socket of FIG. 11A, in an assembled state. For convenience of illustration, the same functional elements as those in the first exemplary embodiment shown in FIGS. 2 through 8, are represented by the same reference numerals, and thus, a detailed description thereof will be omitted. The fourth exemplary embodiment of a lamp socket of the present invention has substantially the same structure as that of the first exemplary embodiment of the present invention except for the points described below.

Referring to FIGS. 11A through 11D, a fourth exemplary embodiment of a lamp socket 700 includes a power connection unit 720 which is electrically connected to an inverter printed circuit board 400, a lamp connection unit 710 which is disposed on the power connection unit 720 and electrically connected to a lamp (not shown), and a fastening member 230, disposed on the lamp connection unit 710 at a border between the lamp connection unit 710 and the power connection unit 720, securing the lamp socket 700 to a lower housing unit 160.

In more detail, the lamp connection unit 710 includes a stepped structure protruding outwardly with respect to the power connection unit 720 and adjoining the power connection unit 720. In more detail, the lamp connection unit 710 includes a light-shielding plate 718 constituting the widest part of the stepped structure, and a first housing 212 disposed on the light-shielding plate 718. The first housing 212 has a guide groove 214 and a lamp connection terminal 216.

The power connection unit 720 includes a board support 224 which is connected to the lamp connection unit 710, a second housing 226 which is disposed on the board support 224, and a power connection terminal 228 which is disposed in the second housing 226 and may be electrically connected to the inverter printed circuit board 400.

The light-shielding plate 718 adjoins the power connection unit 720. The fastening member 230 is disposed on the lamp connection unit 710. The fastening member 230 extends downward from the side of the light-shielding plate 718 opposite the lamp connection unit 710. Therefore, the fourth exemplary embodiment of a lamp socket 700 can be easily and securely inserted into a socket hole 162 of the lower housing unit 160 using the fastening member 230 disposed on a lower surface of the light-shielding plate 718 without using an additional fastener. Meanwhile, when the fourth exemplary embodiment of a lamp socket 700 is inserted into the lamp hole 162, the light-shielding plate 718 may have a larger area than the socket hole 162 to prevent external light from becoming incident on the liquid crystal panel 136.

The fourth exemplary embodiment of a lamp socket 700 is inserted downward into the socket hole 162, it is secured to the lower housing unit 160 by the fastening member 230 disposed on the lower surface of the lamp connection unit 710. The lamp connection unit 710 of the fourth exemplary embodiment of a lamp socket 700 is disposed inside the lower housing unit 160, and the power connection unit 720 of the lamp socket 700 is disposed outside the lower housing unit 160.

According to the fourth exemplary embodiment of a lamp socket 700 of the present invention, the fastening member 230 is disposed on a lower surface of the light-shielding plate 718 and the light-shielding plate 718 is disposed inside the lower housing unit 160. Even though the insertion direction of the lamp socket 700 into the lower housing unit 160 is opposite to that of the first exemplary embodiment of the present invention, the fourth exemplary embodiment of a lamp socket 700 of the present invention can provide substantially the same functions and effects as that of the first exemplary embodiment of the present invention.

Figure 12A:
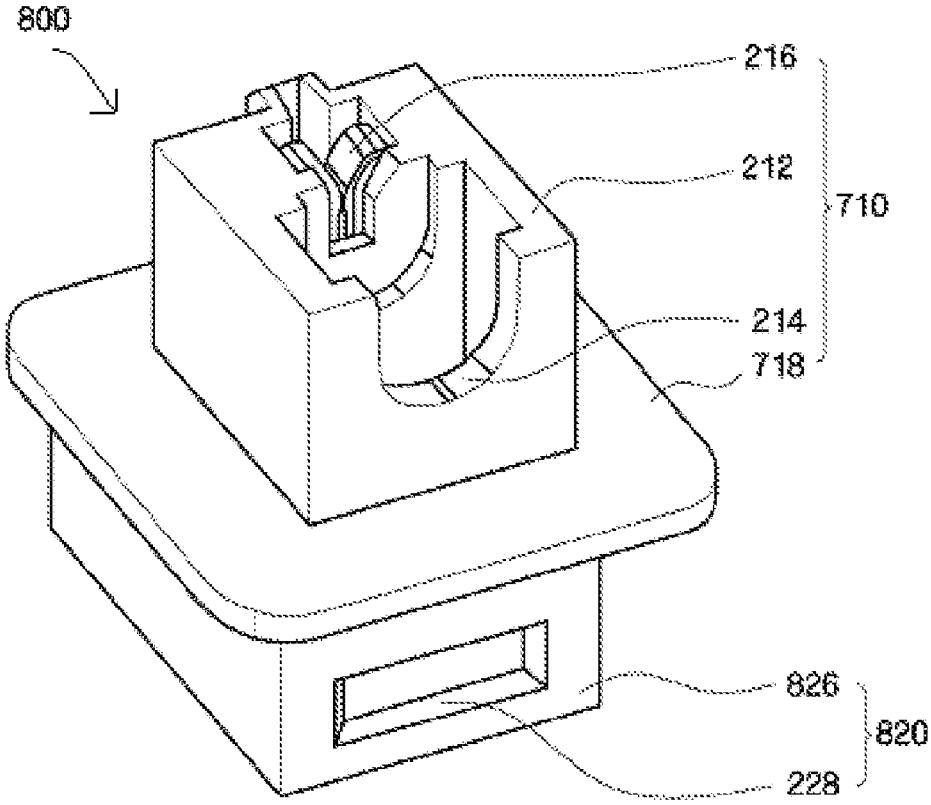
FIG. 12A is a top elevated front perspective view illustrating a fifth exemplary embodiment of a lamp socket according to the present invention.
Figure 12B:
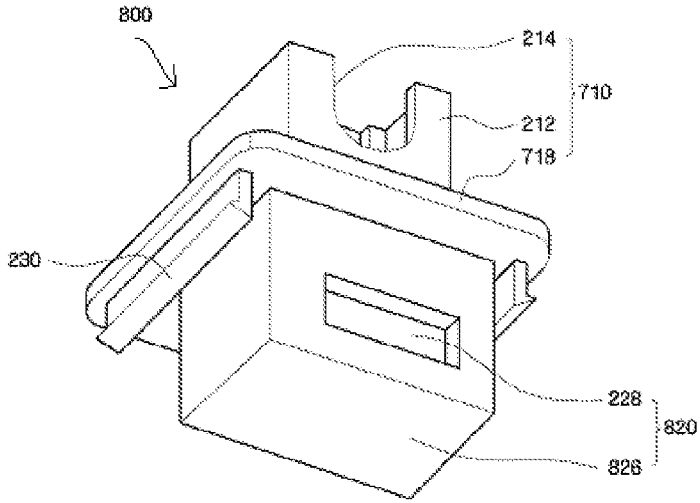
FIG. 12B is a front perspective view, as seen from below, of the fifth exemplary embodiment of the lamp socket of FIG. 12A.
Figure 12C:
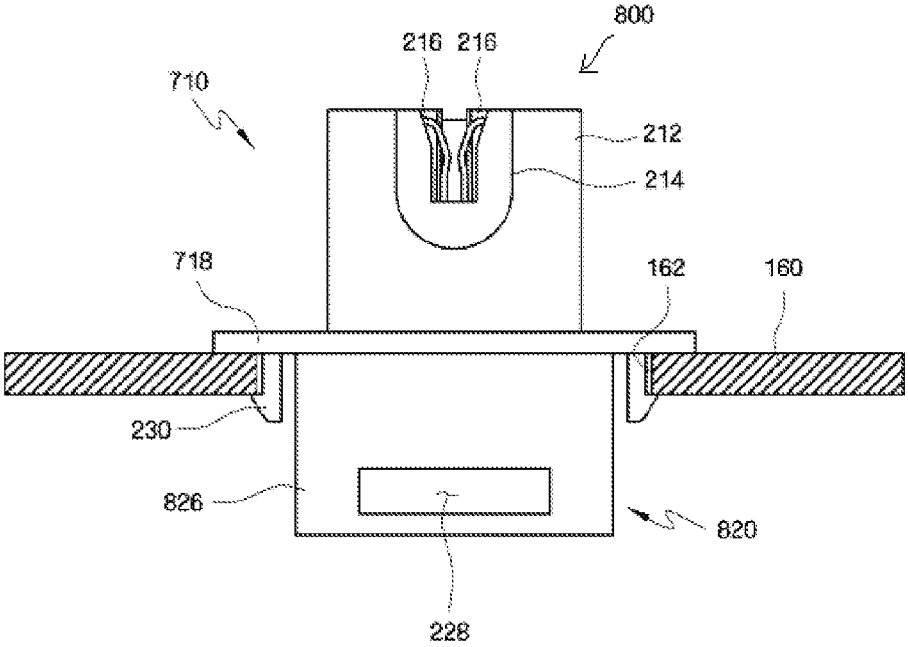
FIG. 12C is a front view illustrating an exemplary embodiment of a lower housing unit and the fifth exemplary embodiment of the lamp socket of FIG. 12A, in an assembled state.
Figure 12D:
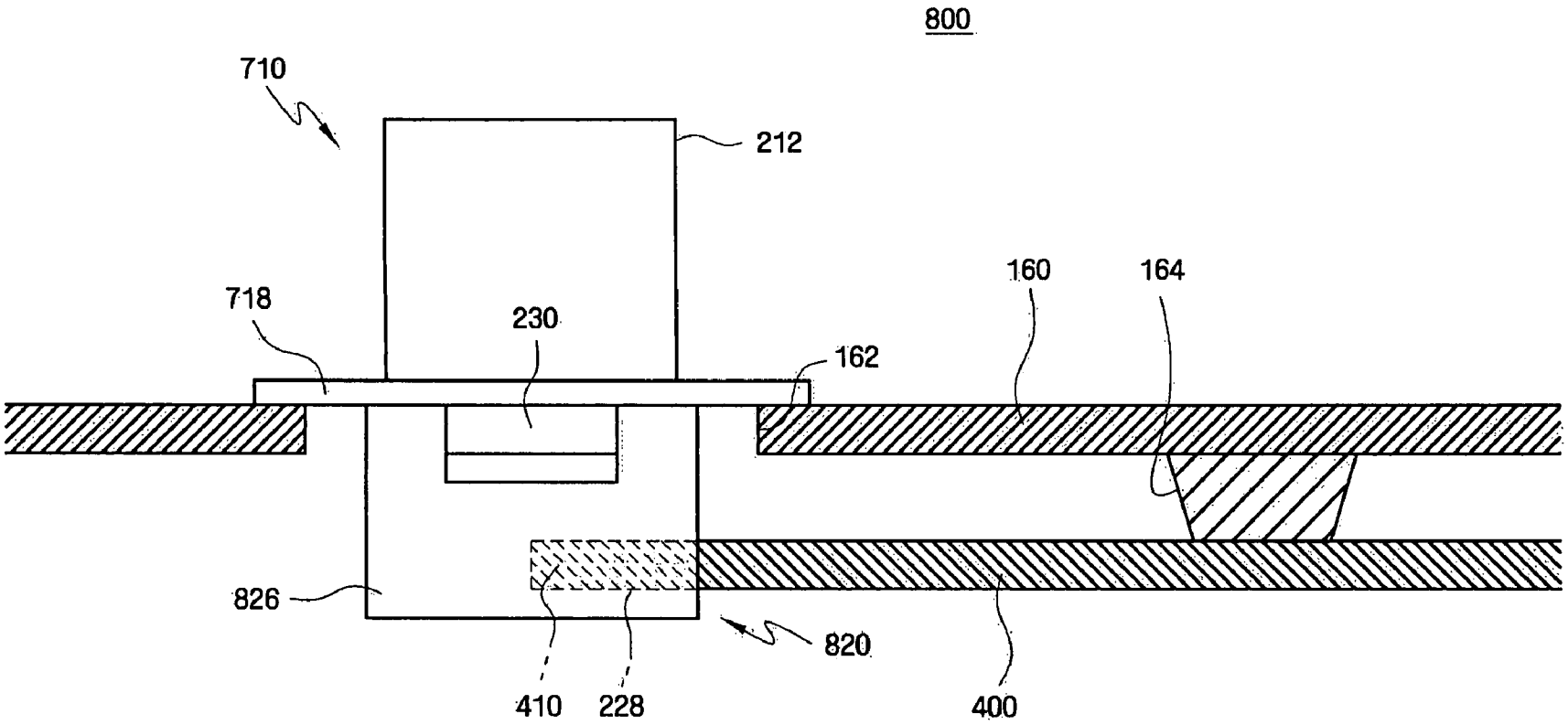
FIG. 12D is a side view illustrating an exemplary embodiment of a lower housing unit, an exemplary embodiment of an inverter printed circuit board, and the fifth exemplary embodiment of the lamp socket of FIG. 12A, in an assembled state.

Hereinafter, a fifth exemplary embodiment of a lamp socket according to the present invention will be described in more detail with reference to FIGS. 12A through 12D. FIG. 12A is an elevated front perspective view illustrating a fifth exemplary embodiment of a lamp socket 800 according to the present invention, FIG. 12B is a front perspective view, as seen from below, of the fifth exemplary embodiment of a lamp socket of FIG. 12A, FIG. 12C is a front view illustrating an exemplary embodiment of a lower housing unit and the fifth exemplary embodiment of the lamp socket of FIG. 12A, in an assembled state, and FIG. 12D is a side view illustrating an exemplary embodiment of a lower housing unit, an exemplary embodiment of an inverter printed circuit board, and the fifth exemplary embodiment of a lamp socket of FIG. 12A, in an assembled state. For convenience of illustration, the same functional elements as those in the fourth exemplary embodiment are represented by the same reference numerals, and thus, a detailed description thereof will be omitted. The lamp socket of the fifth exemplary embodiment of the present invention has substantially the same structure as that of the fourth exemplary embodiment of the present invention except for the points described below.

Referring to FIGS. 12A through 12D, a power connection unit 820 of a fifth exemplary embodiment of a lamp socket 800 includes a second housing 826 which is connected to a lamp connection unit 710, and a power connection terminal 228 which is disposed in the second housing 826 and may be electrically connected to an inverter printed circuit board 400. The fifth exemplary embodiment of a lamp socket 800 is structured such that the power connection terminal 228 of the power connection unit 820 may provide support for supporting the inverter printed circuit board 400. This fifth exemplary embodiment of a lamp socket 800 differs from the sixth exemplary embodiment of a lamp socket 700 in that a separate board support 224 is not provided.

Figure 13A:
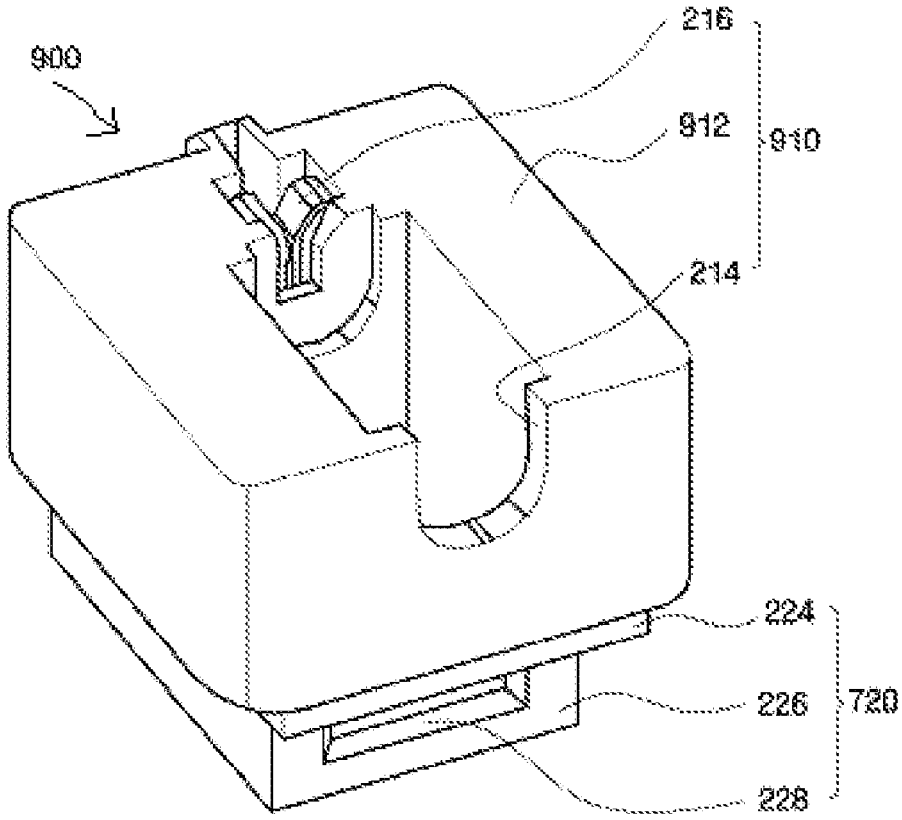
FIG. 13A is a top front perspective view illustrating a sixth exemplary embodiment of a lamp socket according to the present invention.
Figure 13B:
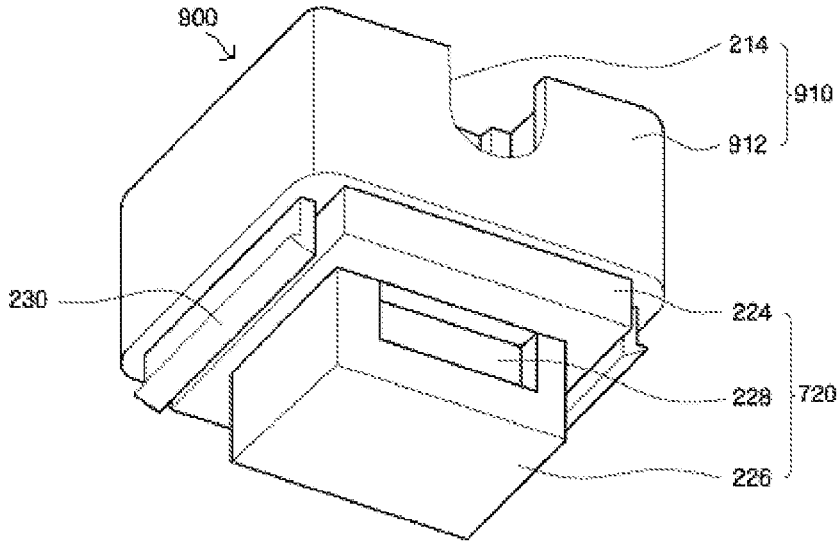
FIG. 13B is a front perspective view, as seen from below, of the sixth exemplary embodiment of the lamp socket of FIG. 13A.
Figure 13C:
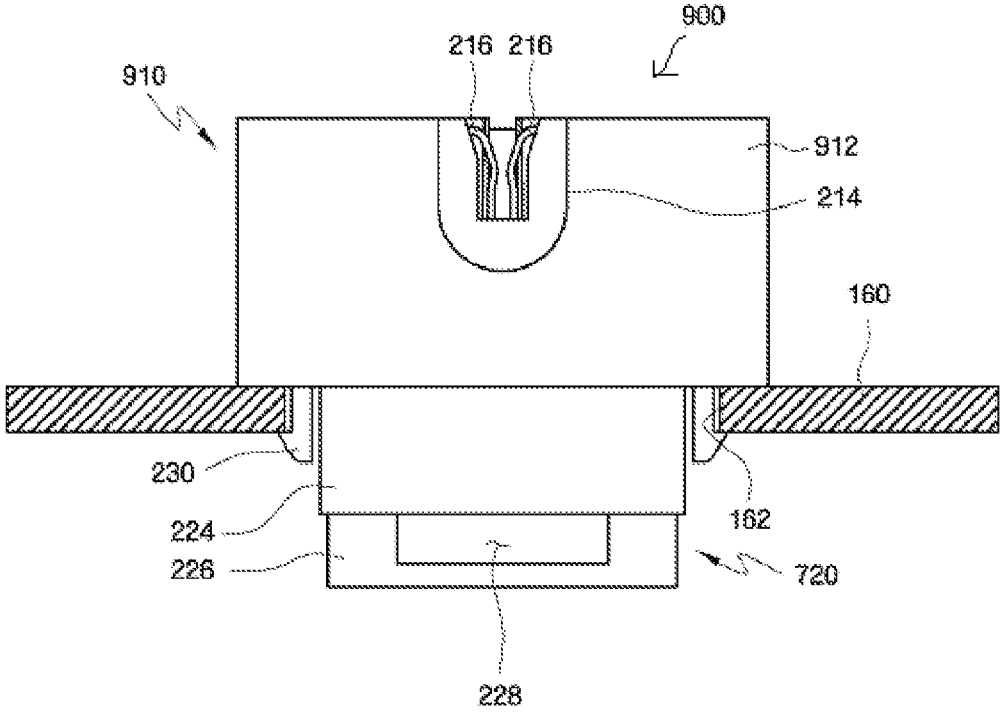
FIG. 13C is a front view illustrating an exemplary embodiment of a lower housing unit and the sixth exemplary embodiment of the lamp socket of FIG. 13A, in an assembled state.
Figure 13D:
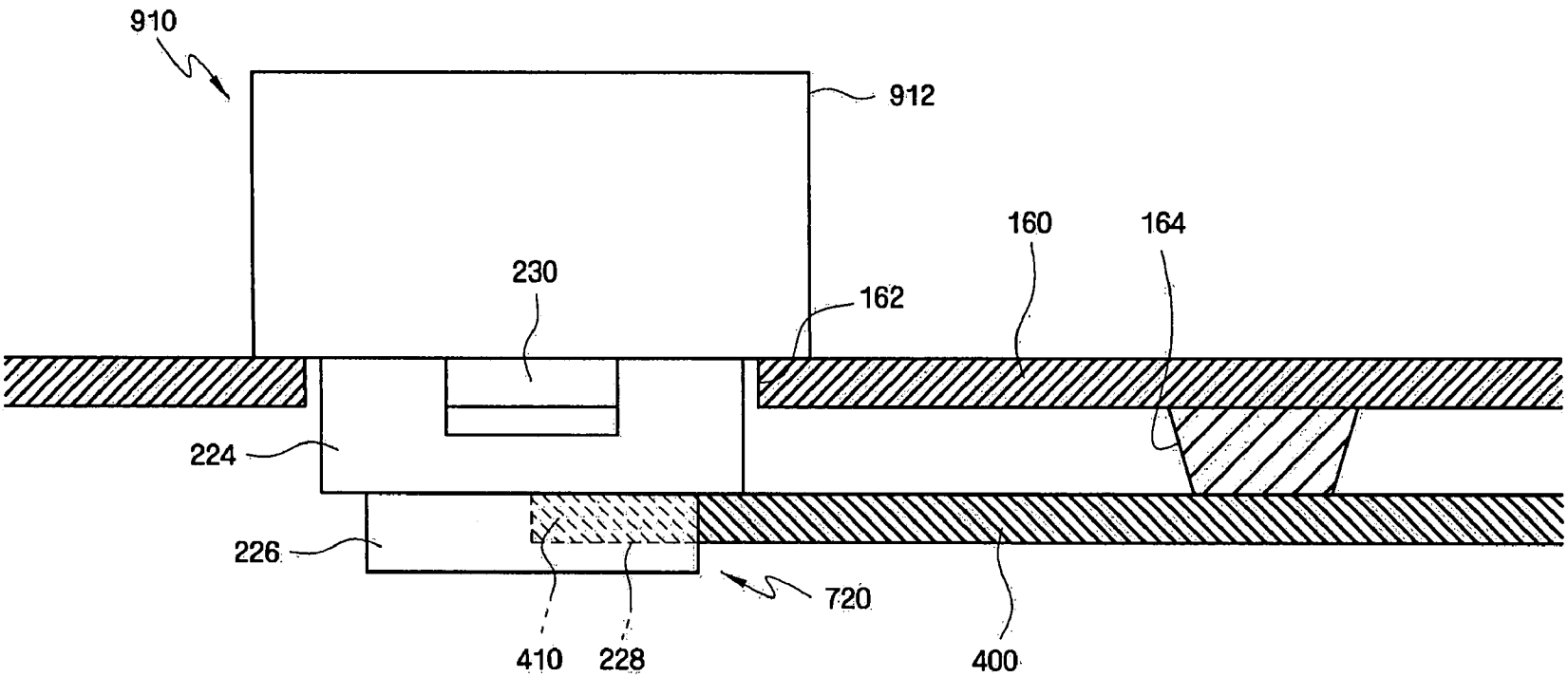
FIG. 13D is a side view illustrating an exemplary embodiment of a lower housing unit, an exemplary embodiment of an inverter printed circuit board, and the sixth exemplary embodiment of the lamp socket of FIG. 13A, in an assembled state.

Hereinafter, a sixth exemplary embodiment of a lamp socket according to the present invention will be described in more detail with reference to FIGS. 13A through 13D. FIG. 13A is a top front perspective view illustrating a sixth exemplary embodiment of a lamp socket 900 according to the present invention; FIG. 13B is a front perspective view, as seen from below, of the sixth exemplary embodiment of a lamp socket of FIG. 13A; FIG. 13C is a front view illustrating an exemplary embodiment of a lower housing unit and the sixth exemplary embodiment of a lamp socket of FIG. 13A, in an assembled state, and FIG. 13D is a side view illustrating an exemplary embodiment of a lower housing unit, an exemplary embodiment of an inverter printed circuit board, and the sixth exemplary embodiment of the lamp socket of FIG. 13A, in an assembled state. For convenience of illustration, the same functional elements as those in the fourth exemplary embodiment, as shown in FIGS. 11A through 11D, are represented by the same reference numerals, and thus, a detailed description thereof will be omitted. The sixth exemplary embodiment of a lamp socket of the present invention has substantially the same structure as that of the fourth exemplary embodiment of the present invention except for the points described below.

Referring to FIGS. 13A through 13D, a lamp connection unit 910 of a sixth exemplary embodiment of a lamp socket 900 includes a first housing 912 made of an insulating material, which constitutes a stepped structure protruding outwardly with respect to a power connection unit 720 and adjoining the power connection unit 720, and a guide groove 214 and a lamp connection terminal 216 which are formed in the first housing 912. The lamp socket 900 is structured to prevent the incidence of external light through a socket hole 162 by disposing the first housing 912 around the socket hole 162. This sixth exemplary embodiment of a lamp socket 900 prevents the incidence of external light without using a light-shielding plate as shown in the previous exemplary embodiments (the third exemplary embodiment of the lamp socket 600 shown in FIGS. 10A-10D also blocks the incidence of external light to the liquid crystal panel 136 without using a separate light-shielding plate, but does so using an enlarged second housing 626).

As described above, a lamp socket according to the present invention can be easily assembled with a backlight assembly, can be applied to various types of liquid crystal displays, and can reduce the manufacturing costs of liquid crystal displays.

While the present invention has been particularly shown and described with reference to exemplary embodiments thereof, it will be understood by those of ordinary skill in the art that various changes in form and details may be made therein without departing from the spirit and scope of the present invention as defined by the following claims. It is therefore desired that the present exemplary embodiments be considered in all respects as illustrative and not restrictive, reference being made to the appended claims rather than the foregoing description to indicate the scope of the present invention.

What is claimed is:

1. A lamp socket comprising:

a power connection unit which is electrically connected to an electric source which supplies power to a lamp;

a lamp connection unit which is disposed above and adjacent to the power connection unit along a longitudinal axis and is electrically connected to the lamp; and a fastening member which is disposed on the lamp connection unit and has an outwardly protruding hook portion to be coupled with a unit provided externally, wherein the lamp connection unit comprises at least one sub-component which has a surface area perpendicular to the longitudinal axis which is larger than the largest surface area of the power connection unit perpendicular to the longitudinal axis and wherein the sub-component of the lamp connection unit with the largest surface area perpendicular to the longitudinal axis is located proximate to the power connection unit.

2. The lamp socket of claim 1, wherein the fastening member is disposed at opposing sides of the power connection unit.

3. The lamp socket of claim 1, wherein the fastening member comprises a hook.

4. The lamp socket of claim 1, wherein the sub-component of the lamp connection unit comprises:

a light-shielding plate;

a first housing which is disposed on the light-shielding plate and is made of an insulating material; and a lamp connection terminal which is disposed in the first housing and is electrically connected to the lamp.

5. The lamp socket of claim 1, wherein the power connection unit comprises:

a second housing made of an insulating material; and a power connection terminal which is disposed in the second housing and is electrically connected to an inverter printed circuit board which supplies power to the lamp.

6. The lamp socket of claim 5, wherein the power connection unit further comprises a board support, which is interposed between the lamp connection unit and the power connection terminal and supports the inverter printed circuit board.

7. The lamp socket of claim 1, wherein the sub-component of the lamp connection unit comprises:

a first housing which is disposed adjacent to the power connection unit; and a lamp connection terminal which is disposed in the first housing and is electrically connected to the lamp.

8. A backlight assembly comprising:

at least one lamp;

a housing unit which receives the at least one lamp and has socket holes corresponding to ends of the at least one lamp; and lamp sockets which are inserted into the socket holes and are connected to the lamps, wherein each of the lamp sockets comprises:

a lamp connection unit which is electrically connected to the lamp;

a power connection unit which is disposed below and adjacent to the lamp connection unit along a longitudinal axis and is electrically connected to an electric source which supplies power to the lamp; and a fastening member which is disposed on the power connection unit and is secured to the socket hole, and has an outwardly protruding hook portion to be coupled with a unit provided externally, wherein the power connection unit comprises at least one sub-component which has a surface area perpendicular to the longitudinal axis which is larger than the largest surface area of the lamp connection unit perpendicular to the longitudinal axis and wherein the sub-component of the power connection unit with the largest surface area perpendicular to the longitudinal axis is located proximate to the lamp connection unit.

9. The backlight assembly of claim 8, wherein the lamp socket is inserted into the corresponding one of the socket holes, and wherein the lamp connection unit is disposed inside the housing unit and the power connection unit is disposed outside the housing unit.

10. The backlight assembly of claim 8, wherein embossing is disposed around the socket holes.

11. A liquid crystal display comprising:

a liquid crystal panel; and the backlight assembly of claim 8 which supplies light to the liquid crystal panel.

12. A method of manufacturing a lamp socket, the method comprising:

forming a power connection unit which is electrically connected to an electric source which supplies power to a lamp;

forming a lamp connection unit which is disposed above and adjacent to the power connection unit along a longitudinal axis and is electrically connected to the lamp; and forming a fastening member which is disposed on the lamp connection unit and has an outwardly protruding hook portion to be coupled with a unit provided externally, wherein the forming a lamp connection unit comprises forming at least one sub-component to have a surface area perpendicular to the longitudinal axis which is larger than the largest surface area of the power connection unit perpendicular to the longitudinal axis and wherein the sub-component of the lamp connection unit with the largest surface area perpendicular to the longitudinal axis is formed proximate to the power connection unit.

* * * * *